US009832586B2

(12) United States Patent
Paik

(10) Patent No.: US 9,832,586 B2
(45) Date of Patent: Nov. 28, 2017

(54) VEHICLE AND CONTROL METHOD FOR THE SAME

(71) Applicant: Hyundai Motor Company, Seoul (KR)

(72) Inventor: Soonkwon Paik, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/948,929

(22) Filed: Nov. 23, 2015

(65) Prior Publication Data

US 2016/0345115 A1 Nov. 24, 2016

(30) Foreign Application Priority Data

May 18, 2015 (KR) ..... 10-2015-0069227

(51) Int. Cl.
*H04S 7/00* (2006.01)

(52) U.S. Cl.
CPC ..... *H04S 7/303* (2013.01); *H04R 2499/13* (2013.01); *H04S 2400/13* (2013.01)

(58) Field of Classification Search
CPC .. H04S 7/303; H04S 2400/13; H04R 2499/13
USPC ..... 381/302, 310; 700/94
See application file for complete search history.

(56) References Cited

U.S. PATENT DOCUMENTS 7,447,321 B2 * 11/2008 Furge ..... H04S 3/02 381/119
7,561,706 B2 * 7/2009 Holmi ..... B60R 11/0217 348/837
7,760,890 B2 * 7/2010 Furge ..... H03G 3/32 381/119
8,170,246 B2 * 5/2012 Yoo ..... H04S 3/008 381/310
8,483,396 B2 * 7/2013 Amadu ..... H04R 5/02 381/1
2012/0121113 A1 * 5/2012 Li ..... H04R 1/403 381/302
2012/0314889 A1 * 12/2012 Mizuno ..... H04S 3/002 381/302

FOREIGN PATENT DOCUMENTS

| | | | |
|---|---|---|---|
| JP | 2005-047479 | A | 2/2005 |
| JP | 2006-194633 | A | 7/2006 |
| JP | 2006-295443 | A | 10/2006 |
| JP | 2007-286490 | A | 11/2007 |
| KR | 2000-0026074 | A | 5/2000 |
| KR | 10-2007-0104668 | A | 10/2007 |
| KR | 2013-0079872 | A | 7/2013 |
| KR | 2013-0141156 | A | 12/2013 |
| KR | 2015-0013999 | A | 2/2015 |

* cited by examiner

*Primary Examiner* — David Ton
(74) *Attorney, Agent, or Firm* — Mintz Levin Cohn Ferris Glovsky and Popeo, P.C.; Peter F. Corless

(57) ABSTRACT

A vehicle and a control method of the vehicle are provided. The vehicle includes a first controller that is configured to provide a media sound source via a first virtual speaker. Additionally, the apparatus includes a second controller that is configured to provide the event sound source via a second virtual speaker, which is formed in a layer different from the first virtual speaker, when an event sound source is input.

13 Claims, 50 Drawing Sheets

FIG. 16

| | CH1 | CH2 | CH2 | CH3 | CH4 |
|---|---|---|---|---|---|
| K | $K_1$ | $K_2$ | $K_3$ | $K_4$ | $K_5$ |
| Θ | $\Theta_1$ | $\Theta_2$ | $\Theta_3$ | $\Theta_4$ | $\Theta_5$ |

VEHICLE AND CONTROL METHOD FOR THE SAME

CROSS-REFERENCE TO RELATED APPLICATION(S)

This application claims the benefit of Korean Patent Application No. 10-2015-0069227, filed on May 18, 2015 in the Korean Intellectual Property Office, the disclosure of which is incorporated herein by reference.

BACKGROUND

1. Field of the Disclosure

The present disclosure relates to a vehicle capable of providing stereophonic sounds and a control method of the vehicle.

2. Description of Related Art

In a vehicle, an audio system may be mounted to allow a driver to listen to music with high quality, to suit the driver preferences. The audio system may include a radio, a cassette, a compact disc player (CDP), or a MP3 player. Meanwhile, the vehicle may particular a driver with particular information using the audio system. For example, the vehicle may output guidance sound that provides information for the driving, or output a warning sound that provides a notification regarding dangerous situation via the audio system.

The convenience of the driver may be improved by providing a variety of sounds via the audio system, but there may be difficulties in delivering a plurality of sound sources effectively since the number of sound source delivered via the audio system is increased.

SUMMARY

Therefore, the present disclosure provides a vehicle capable of delivering a plurality of sound sources effectively and a control method of the vehicle. Additional aspects of the present disclosure will be set forth in part in the description which follows and, in part, will be obvious from the description, or may be learned by practice of the present disclosure.

In accordance with one aspect of the present disclosure, a vehicle may include a plurality of speakers disposed at different heights and a sound controller configured to provide a plurality of sound sources by forming a plurality of virtual speakers, which output a sound source using the plurality of speakers, in different positions. The sound controller may be configured to detect a speaker among the plurality of speakers, to which an audio signal that corresponds to a sound source is applied, based on a position of the virtual speaker. The sound controller may then be configured to generate an audio signal, to be applied to each of the plurality of speakers, based on a distance between the plurality of speakers and the virtual speaker.

Additionally, the sound controller may be configured to adjust a gain of the audio signal, to be applied to each of the plurality of speakers, based on a distance between the plurality of speakers and the virtual speaker. The sound controller may also be configured to adjust an output timing of the audio signal and adjust a frequency of the audio signal, to be applied to each speaker, based on a distance between each speaker and the virtual speaker.

The sound controller may be configured to generate the audio signal, to be applied to the plurality of speakers, based on the following Equation 1.

$$S^n(t, f) = k_n \cdot A(t) \cdot e^{j2\pi\left(\left(1 + \frac{\Theta_n}{c}\right) \cdot f\right) \cdot t} \quad \text{Equation 1}$$

wherein, S may represent the audio signal, n may represent each channel of the speaker, t may represent an output time of the audio signal, A may represent the size of a sound source to be provided via the virtual speaker, f may represent a frequency of a sound source to be provided via the virtual speaker, c may represent the speed of sound when air is the medium, k may represent a variation to adjust a gain of the audio signal based on a distance between the virtual speaker and each speaker, and θ may represent a variation to adjust a frequency of the audio signal based on a distance between the virtual speaker and each speaker.

The sound controller may be configured to form a plurality of virtual speakers in different layers according to the priority of recognition. The sound controller may further be configured to set a virtual speaker that corresponds to a sound source having a high priority of recognition among a plurality of sound sources, in a layer that corresponds to a height of a driver's face, and may be configured to set a virtual speaker that corresponds to a sound source having a low priority of recognition among the plurality of sound sources, in a layer lower than the height of the driver's face. The sound controller may be configured to set plane coordinates of the plurality of virtual speakers to form a virtual speaker that corresponds to a sound source having a high priority of recognition among the plurality of sound sources to be closer to a driver than a virtual speaker that corresponds to a sound source having a high priority of recognition among a plurality of sound sources. The sound controller may be configured to provide a sound source having a high priority of recognition as a high pitch sound, and a sound source having a low priority of recognition as a low pitch sound.

In accordance with another aspect of the present disclosure, a vehicle may include a first controller configured to provide a media sound source via a first virtual speaker, and a second controller configured to form a second virtual speaker in a position different than the first virtual speaker when an event sound source is input, and configured to provide the event sound source via the second virtual speaker. The vehicle may further include an event handler configured to determine a layer in which the second virtual speaker is formed according to the priority of recognition of the event sound source.

The vehicle may further include an event handler configured to determine plane coordinates in which the second virtual speaker is formed according to the priority of recognition of the event sound source. The second controller may be configured to generate an audio signal, to be applied to each of the plurality of speakers, based on a distance between the plurality of speakers disposed within the vehicle and the second virtual speaker. The second controller may be configured to generate the audio signal, to be applied to the plurality of speakers, based on the following Equation 1.

$$S^n(t, f) = k_n \cdot A(t) \cdot e^{j2\pi\left(\left(1 + \frac{\Theta_n}{c}\right) \cdot f\right) \cdot t} \quad \text{Equation 1}$$

wherein, S may represent the audio signal, n may represent each channel of the plurality of speakers, t may represent an output time of the audio signal A may represent the size of the event sound source, f may represent a frequency of the event sound source, c may represent the speed of sound when air is the medium, k may represent a variation to adjust a gain of the audio signal according to a distance between the second virtual speaker and each speaker, and θ may represent a variation to adjust a frequency of the audio signal according to a distance between the second virtual speaker and each speaker.

The second controller may be configured to determine a repetition period of a beep sound based on the priority of recognition of the event sound source when the event sounds source is a beep sound. The second controller may be configured to generate the audio signal, to be applied to the plurality of speakers, based on the following equation 2

$$S^n(t, f) = k_n \cdot A(t) \cdot e^{j \cdot 2\pi\left(\left(1 + \frac{\Theta_n}{c}\right) \cdot f\right) \cdot (t^* T_n)} \quad \text{Equation 2}$$

wherein, S may represent the audio signal, n may represent each channel of the plurality of speakers, t may represent an output time of the audio signal A may represent the size of the event sound source, f may represent a frequency of the event sound source, c may represent the speed of sound when air is the medium, k may represent a variation to adjust a gain of the audio signal according to a distance between the second virtual speaker and each speaker, θ may represent a variation to adjust a frequency of the audio signal according to a distance between the second virtual speaker and each speaker and T may represent the repetition period.

In accordance with another aspect of the present disclosure, a control method of a vehicle may include setting a plurality of virtual speakers, configured to provide each sound source, in different positions based on the priority of recognition of the plurality of sound sources, and providing the plurality of sound sources simultaneously using the plurality of virtual speakers. The setting may include at least one operation of determining a gain to be applied to each of the plurality of speakers based on a distance between the plurality of speakers and the virtual speaker, determining an output timing of an audio signal based on a distance between each speaker and the virtual speaker, and adjusting a frequency of an audio signal, to be applied to each speaker, based on a distance between each speaker and the virtual speaker.

BRIEF DESCRIPTION OF THE DRAWINGS

These and/or other aspects of the disclosure will become apparent and more readily appreciated from the following description of exemplary embodiments, taken in conjunction with the accompanying drawings of which:

FIG. 16 is a view illustrating an example of a parameter lookup table in accordance with one exemplary embodiment of the present disclosure;

DETAILED DESCRIPTION

Figure 1:
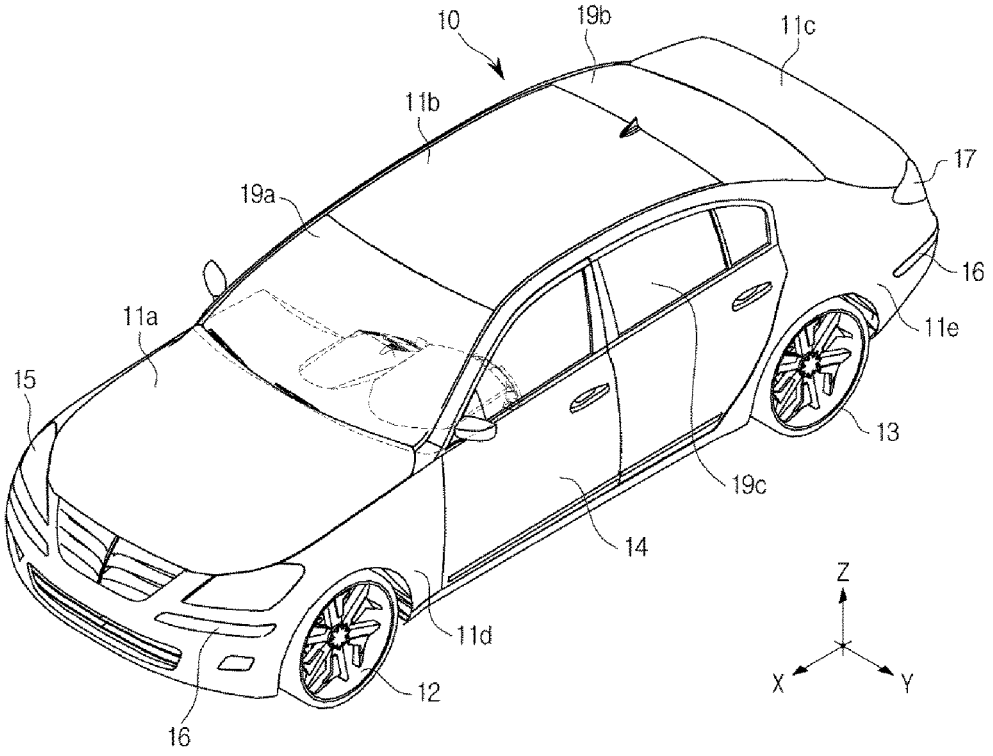
FIG. 1 is a view schematically illustrating a vehicle in accordance with one exemplary embodiment of the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

Furthermore, control logic of the present invention may be embodied as non-transitory computer readable media on a computer readable medium containing executable program instructions executed by a processor, controller/control unit or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed in network coupled computer systems so that the computer readable media is stored and executed in a distributed fashion, e.g., by a telematics server or a Controller Area Network (CAN).

The terminology used herein is for the purpose of describing particular embodiments only and is not intended to be limiting of the invention. As used herein, the singular forms "a", an and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

The present disclosure will now be described more fully with reference to the accompanying drawings, in which exemplary embodiments of the disclosure are shown. The disclosure may, however, be embodied in many different forms and should not be construed as being limited to the exemplary embodiments set forth herein; rather, these exemplary embodiments are provided so that this disclosure will be thorough and complete, and will fully convey the concept of the disclosure to those skilled in the art. In the description of the present disclosure, if it is determined that a detailed description of commonly-used technologies or structures related to the exemplary embodiments of the present disclosure may unnecessarily obscure the subject matter of the disclosure, the detailed description will be omitted.

Reference will now be made in detail to exemplary embodiments of the present disclosure, examples of which are illustrated in the accompanying drawings. Prior to the description of a vehicle in accordance with one exemplary embodiment, the overall configuration of a vehicle will be described.

Figure 2:
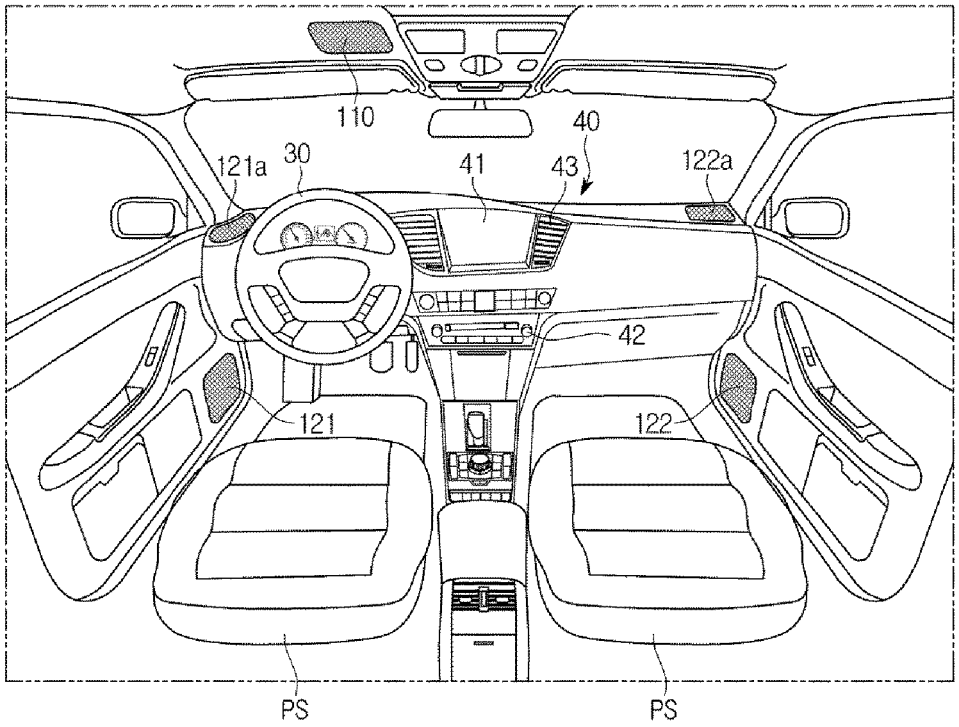
FIG. 2 is a view schematically illustrating an internal space of a vehicle in accordance with one exemplary embodiment of the present disclosure.

FIG. 1 is a view schematically illustrating a vehicle 1 in accordance with one exemplary embodiment of the present disclosure and FIG. 2 is a view schematically illustrating an internal space of a vehicle in accordance with one exemplary embodiment of the present disclosure. Referring to FIG. 1, the vehicle 1 may include a body that forms an exterior of the vehicle 1, and vehicle wheels 12 and 13 configured to move the vehicle 1.

The body may include a hood 11*a* that protects a variety of devices mounted therein, which are used to drive the vehicle 1, e.g., an engine, a roof panel 11*b* that forms an inner space, a trunk lid 11*c* provided with a storage space, a front fender 11*d* and a quarter panel 11e disposed on the side of the vehicle 1. In addition, a plurality of doors 15 hinge-coupled to the body may be disposed on the side of the body. Between the hood 11*a* and the roof panel 11*b*, a front window 19*a* may be disposed to provide a view of a front side of the vehicle 1, and between the roof panel 11*b* and the trunk lid 11*c*, a rear window 19*b* may be disposed to provide a view of a back side of the vehicle 1. In addition, on an upper side of the door 15, a side window 19*c* may be disposed to provide a view of a lateral side.

A headlamp 15 configured to emit a light in a driving direction of the vehicle 1 may be disposed on the front side of the vehicle 1. A turn signal lamp 16 configured to indicate a driving direction of the vehicle 1 may be disposed on the front and rear side of the vehicle 1. The vehicle 1 may be configured to display a driving direction thereof by flashing the turn signal lamp 16. A tail lamp 17 may be disposed on the rear side of the vehicle 1. The tail lamp 17 may be disposed on the rear side of the vehicle 1 to display gear transmission condition and brake operation condition of the vehicle 1.

Referring to FIG. 2, in the vehicle 1, a driver seat DS and a passenger seat PS may be disposed, and a dashboard 40 may be disposed wherein a steering wheel 30 configured to manipulate a driving direction of the vehicle 1, and a variety of gauges configured to display the driving information of the vehicle 1 may be disposed in the dashboard 40. A display unit 41 may be disposed in the center of the dashboard 40, and may be configured to provide information related to the vehicle 1, and an interface configured to input a control command of the vehicle 1. The display unit 41 may be implemented by Plasma Display Panel (PDP), Liquid Crystal Display (LCD) panel, Light Emitting Diode (LED) panel, Organic Light Emitting Diode (OLED) panel, or Active-matrix Organic Light-Emitting Diode (AMOLED) panel, but is not limited thereto. In the dashboard 40, a center fascia 42 in which a manipulation device for operating a variety of devices mounted within the vehicle 1, e.g., an air conditioner, may be disposed, and a blower 43 configured to introduce air to the inside of the vehicle 1 may be provided.

Figure 3:
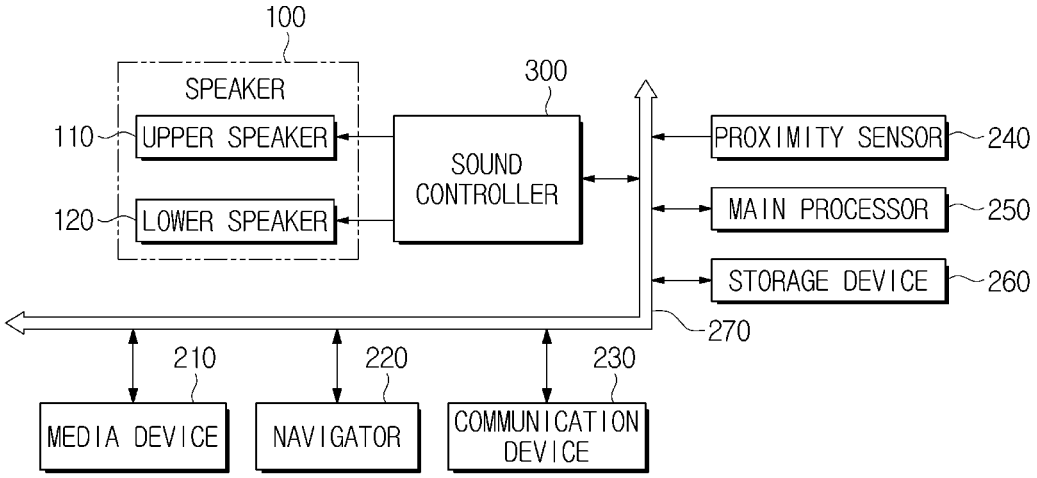
FIG. 3 is a control block diagram illustrating main components of a vehicle in accordance with one exemplary embodiment of the present disclosure.
Figure 4A:
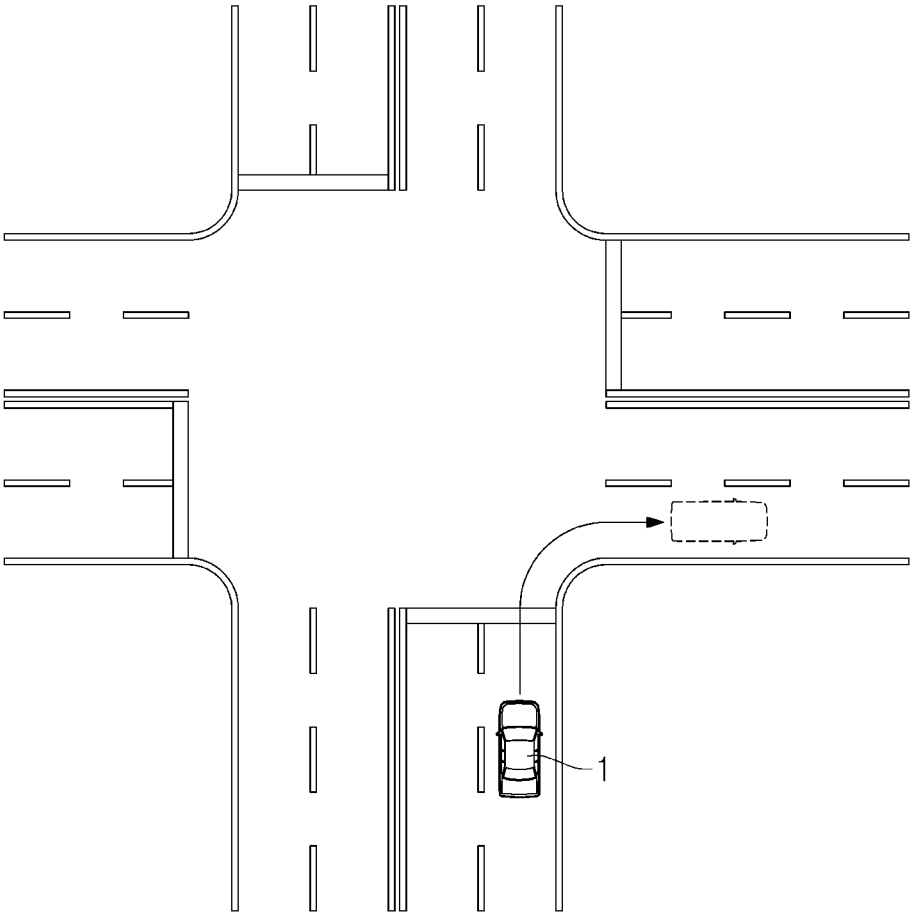
FIGS. 4A-4B are views illustrating an example of a guide sound source provided from a navigator in accordance with one exemplary embodiment of the present disclosure.
Figure 4B:
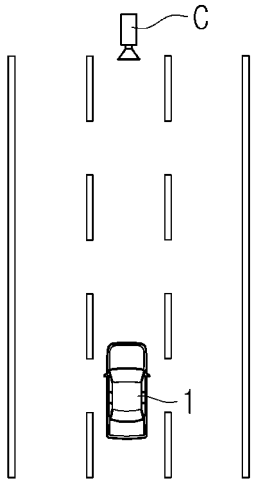

FIG. 3 is a control block diagram illustrating main components of a vehicle in accordance with one exemplary embodiment of the present disclosure FIG. 4 is a view illustrating an example of a guide sound source provided froth a navigator, and FIG. 5 is a view illustrating an example of a warning sound source provided from a main processor. Referring to FIG. 3, the vehicle 1 according to one exemplary embodiment may include a speaker 100, a sound controller 300, a media device 210, a navigator 220, a communication device 230, a storage device 260, a proximity sensor 240, and a main processor 250.

The sound controller 300, the media device 210, the navigator 220, the communication device 230, the storage device 260, the proximity sensor 240, and the main processor 250 may be configured to exchange data via a data bus 270. The sound controller 300 may be configured to receive an input of output object sound source, generate an audio signal that corresponds to the output object sound source in the speaker 100, and may he configured to provide the output object sound source by applying the generated audio signal to the speaker 100.

The output object sound source may represent a sound source to be provided to the inside of the vehicle 1 via the sound controller 300. For example, the output object sound source may include a media sound source configured to provide media, e.g., radio, and music, a telephone sound source configured to provide calling, a guide sound source configured to provide information, and a warning sound source configured to provide a notification regarding a dangerous situation. Hereinafter the sound controller 300 will be described in detail. The media device 210 may be configured to provide a media sound source. For example, the media device 210 may be configured to extract a media sound source from voice media, e.g., a radio, a compact disc, and MP3. In addition, the media device 210 may be configured to extract a media sound source from image media, e.g., movie and Digital Multimedia Broadcasting (DMB).

As mentioned above, the media sound source output from the media device 210 may be delivered to the sound controller 300 via the data bus 270. The navigator 220 may be configured to provide route guidance toward a destination. The navigator 220 may be configured to detect a current position of the vehicle 1, and may be configured to detect a path from the current position of the vehicle 1 toward a set destination. A best-path search algorithm may be used to detect a path toward the destination.

The navigator 220 may be configured to provide the path toward the destination via the display unit 41, and provide the path toward the destination using a sound guidance regarding the path toward the destination. The navigator 220 for the sound guide may be configured to generate and output a guide sound source. As mentioned above, the guide sound source output from the navigator 220 may be delivered to the sound controller 300 via the data bus 270. For example, as illustrated in FIG. 4A, when changing a driving direction of the vehicle 1 is required, the navigator 220 may be configured to output a sound guidance by generating a guide sound source, e.g., "turn left in front 100M."

As illustrated in FIG. 413, when a speed camera is positioned in front of the vehicle (e.g., facing toward the vehicle at a distance in front of the vehicle), the navigator 220 may be configured to output a sound guidance by generating a guide sound source, e.g., "keep a safe speed," Referring to FIG. 3 again, the communication device 230 may be configured to transmit and receive data with an external device. The communication device 230 may be connected to the external device via wired/wireless communication module, and local area communication, and may be configured to transmit data to or receive data from the external device.

For example, the communication device 230 may be configured to receive a guidance sound source or a warning sound source from a telematics server, and may be configured to deliver the guide sound source or the warning sound source, received via the data bus 270, to the sound controller 300. The connection to a mobile terminal of a driver allows the communication device 230 to receive a phone sound source from the mobile terminal, and the communication device 230 may be configured to perform a function of a hand free telephone configured to transmit voice collected via a microphone installed within the vehicle 1. Particularly, the mobile terminal and the communication device 230 may be connected via Bluetooth communication protocol, but is not limited thereto.

As illustrated in FIG. 5, multiple proximity sensors 240 may be provided and each proximity sensor 240 may be configured to detect a distance to an adjacent object using infrared rays, or ultrasonic waves, but a method of detecting a distance by the proximity sensor 210 is not limited thereto. In particular, the adjacent object may represent an obstacle, a pedestrian, and an adjacent vehicle. The main processor 250 may be configured to operate the vehicle 1 and other device installed within the vehicle 1 or a controller. The main processor 250 may be implemented by a plurality of logic gate array, and may include a memory in which a program executed in the main processor 250 is stored.

The main processor 250 may be configured to provide a notification regarding a dangerous situation to a driver through an audio guidance. Particularly, the main processor 250 may be configured to generate a warning sound source to provide a notification regarding a dangerous situation, and may be configured to deliver the generated warning sound source to the sound controller 300 via the data bus 270. For example, the main processor 250 may be configured to generate the warning sound source based on information related to an adjacent object detected by the proximity sensor 240.

Figure 5A:
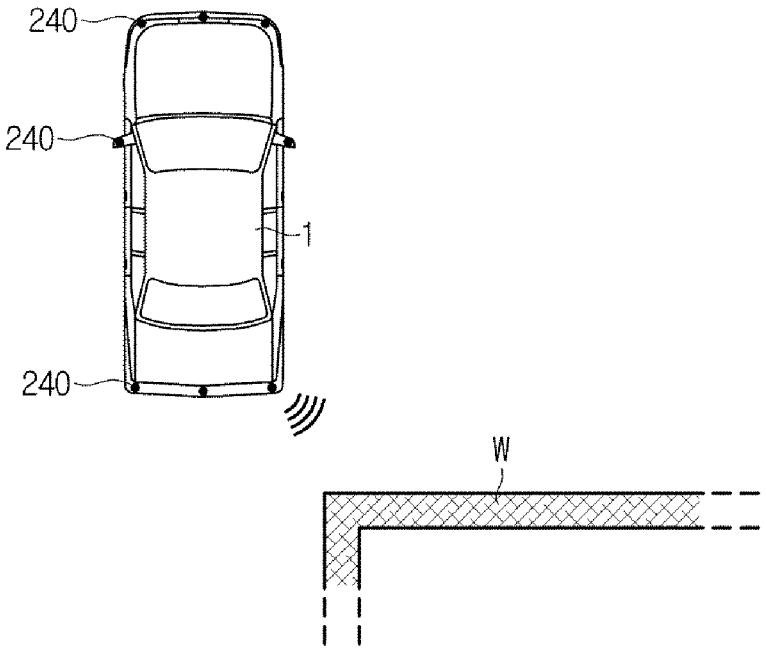
FIGS. 5A-5B are views illustrating an example of a warning sound source provided from a main processor in accordance with one exemplary embodiment of the present disclosure.
Figure 5B:
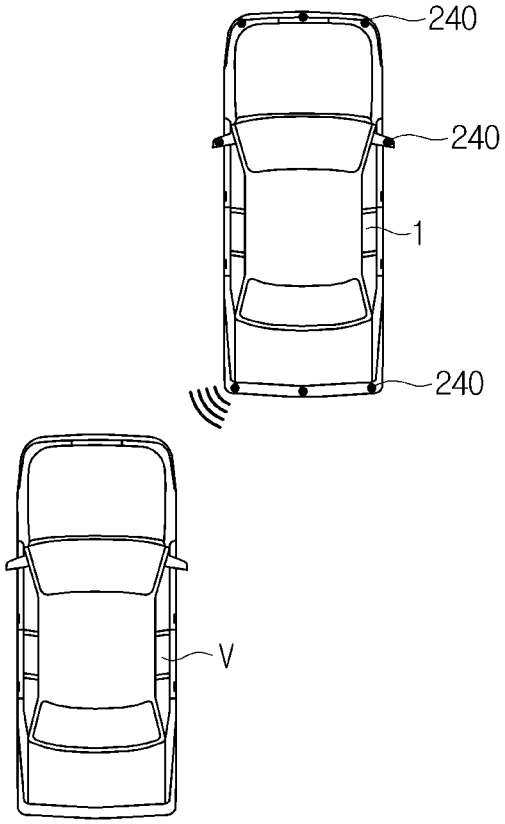

As illustrated in FIG. 5A, when the vehicle 1 is moved backward moved it reverse, the vehicle 1 may be configured to generate a warning sound source to provide a notification regarding a distance between an obstacle W detected at the rear side of the vehicle 1, and the vehicle 1 itself. Particularly, the main processor 250 may he configured to analyze the position of the obstacle and the distance between the obstacle W and the vehicle 1 based on a sensing value of the proximity sensor 240, and may be configured to generate a warning sound source corresponding thereto. As illustrated in FIG. 5B, when the vehicle 1 is driven, the vehicle 1 may be configured to generate a warning sound source to provide a notification regarding a distance to an adjacent vehicle (V). Particularly, the main processor 250 may be configured to analyze whether of the presence of the adjacent vehicle (V), and a distance to the adjacent vehicle (V) based on a sensing value of the proximity sensor 240, and may be configured to generate a warning sound source corresponding thereto.

Referring to FIG. 3 again, the vehicle 1 may further include the storage device 260. The storage device 260 may be configured to store data required for the driving of the vehicle 1, and may be implemented by high-speed random access memory, magnetic disc, static random access memory (SRAM), dynamic random access memory (DRAM), read only memory (ROM), but is not limited thereto. Additionally, FIG. 3 illustrates that the main processor 250 and the storage device 260 formed to be separated from each other, but the main processor 250 and the storage device 260 may be implemented by a single module. In addition, the media device 210, the navigator 220, and the communication device 230 may be implemented by a single device. Prior to the description of the sound controller 300, the speaker 100 mounted within the vehicle 1 will be described in detail.

Figure 6A:
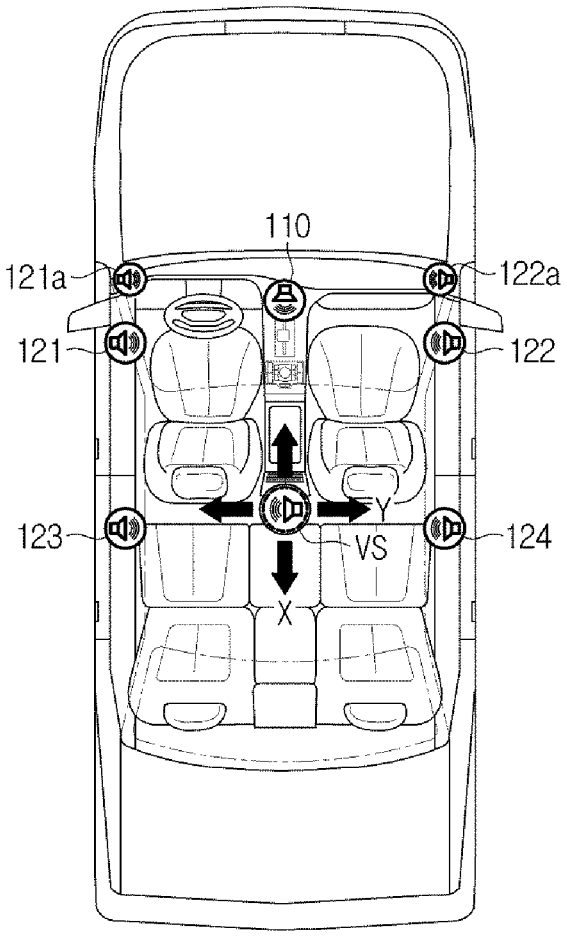
FIGS. 6A-6C are views illustrating a speaker provided in a vehicle in accordance with one exemplary embodiment of the present disclosure.
Figure 6B:
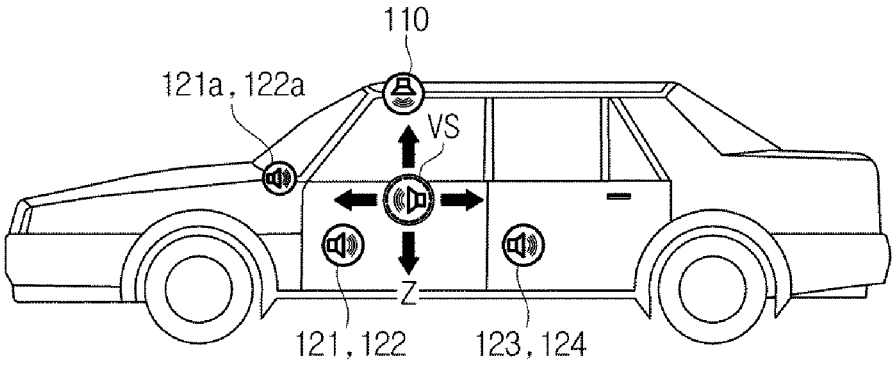
Figure 6C:
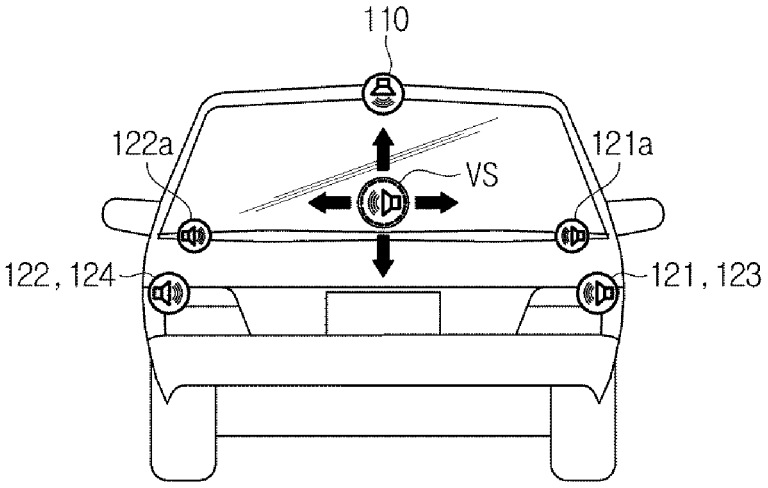

FIG. 6A is a top plan view schematically illustrating a speaker mounted within a vehicle in accordance with one exemplary embodiment of the present, FIG. 6B is a lateral view schematically illustrating a speaker provided in a vehicle in accordance with one exemplary embodiment of the present, and FIG. 6C is a front view schematically illustrating a speaker provided in a vehicle in accordance with one exemplary embodiment of the present.

As illustrated in FIGS. 2 and 6, a plurality of speakers 100 may be disposed inside the vehicle. The sound controller 300 may be configured to output a realistic stereo sound to a driver or a passenger within the vehicle by operating the plurality of speakers 100 mounted within the vehicle 1. Particularly, the plurality of speakers 100 may be disposed to be separated in four directions of front, back, left and right in the vehicle 1, or may be disposed to be separated in an upper side and a lower side of the vehicle 1, as illustrated in FIGS. 6A-6C.

Particularly, the speaker 100 may include an upper speaker 110 and a lower speaker 120. The upper speaker 110 may be disposed in an upper portion of an internal space, and may be disposed on a head lining near a driver seat, but the position of the upper speaker 110 is not limited thereto. For example, the upper speaker 110 may be disposed an upper side of a A filler, a B filler or a C filler other than the head lining. In addition, FIGS. 6A-6C and 7 illustrate that a single upper speaker 110 is provided, but a plurality of upper speakers 110 may be mounted within the vehicle 1. The lower speaker 120 may be disposed in a lower side of an internal space of the vehicle 1 and may include a first lower speaker 121 disposed in the front left side, a second lower speaker 122 disposed in the front right side, a third lower speaker 123 disposed in the back left side, and a fourth lower speaker 124 disposed in the back right side.

Further, the lower speaker 120 may be disposed inside the door, as illustrated in FIG. 2, but the position of the lower speaker 120 is not limited thereto. In addition, FIGS. 6A-6C illustrate that the lower speakers 120 are disposed in each door, and thus four lower speakers 120 are disposed within the vehicle, but the number of the lower speaker 120 is not limited thereto. The lower speaker 120 may further include a sub speaker 121*a* and 121*b*. The sub speaker 121*a* and 121*b* may be disposed in a middle height between the upper speaker 110 and the lower speaker 120 to provide more realistic stereo sound.

For example, the sub speaker 121*a* and 121*b* may he disposed on an upper side of the dashboard 40, as illustrated in FIG. 2, but the position of the sub-speaker 121*a* and 121*b* is not limited thereto. For example, the sub-speaker 121*a* and 121*b* may be disposed in a position that corresponds to a door handle or may be embedded inside the driver seat. In addition, the sub speaker 121*a* and 121*b* may be implemented by a tweeter speaker 100 configured to output high pitch sound to provide more realistic sound to a driver. The sub speaker 121*a* and 121*b* may be configured to receive an audio signal via a channel separated from the lower speaker 120, but hereinafter the sub speaker 121*a* and 121*b* will be described to receive an audio signal via the same channel as the first and second lower speaker 1 and 122.

FIGS. 6A-6C illustrate an example among a variety of speakers mounted within the vehicle, but the position of the speaker 100 of the vehicle 1 is not limited thereto. For example, a surround speaker may be disposed on a rear side of the vehicle. Meanwhile, the sound controller 300 may be configured to form a virtual speaker inside the vehicle 1 using the plurality of speakers 100 mounted within the vehicle, and may be configured to provide an output object sound source via the virtual speaker. In comparison with the real speaker 100, the virtual speaker may represent a speaker, formed virtually on a particular position inside the vehicle 1 by the sound controller 300. A driver may recognize that the output object sound source is output from the virtual speaker VS. The virtual speaker VS may be formed using head-related transfer function (HRTF). A method of forming the virtual speaker VS may he well known to people in the art, and a detail description will be omitted.

The sound controller 300 may he configured to determine a position of the virtual speaker VS based on an output object sound source, to be provided to the inside of the vehicle 1. The position of the virtual speaker VS may be defined as a forward and backward direction of the vehicle 1 (X-axis of FIGS. 6A-6C), a left and right direction of the vehicle (Y-axis of FIGS. 6A-6C), and an upward and downward direction of the vehicle (Z; a height direction). Hereinafter a position in four directions of forward, backward, left and right (X-Y plane of FIG. 6A) may be defined as plane coordinates, and an upward and downward direction may be defined as a height of the vehicle or a layer. In other words, different layers may represent different heights from each other.

The sound controller 300 may be configured to dynamically change the position of the virtual speaker VS based on an output object sound source to be output. In other words, based on an output object sound source, the position of the virtual speaker VS may be moved in a forward and backward direction (X) of the vehicle, as illustrated in FIGS. 6A and 6B, or may be moved in a left and right direction (Y) of the vehicle, as illustrated in FIGS. 6A and 6C. In addition, based on an output object sound source, the layer of the virtual speaker VS may be changed, as illustrated in FIGS. 6B and 6C.

Figure 7:
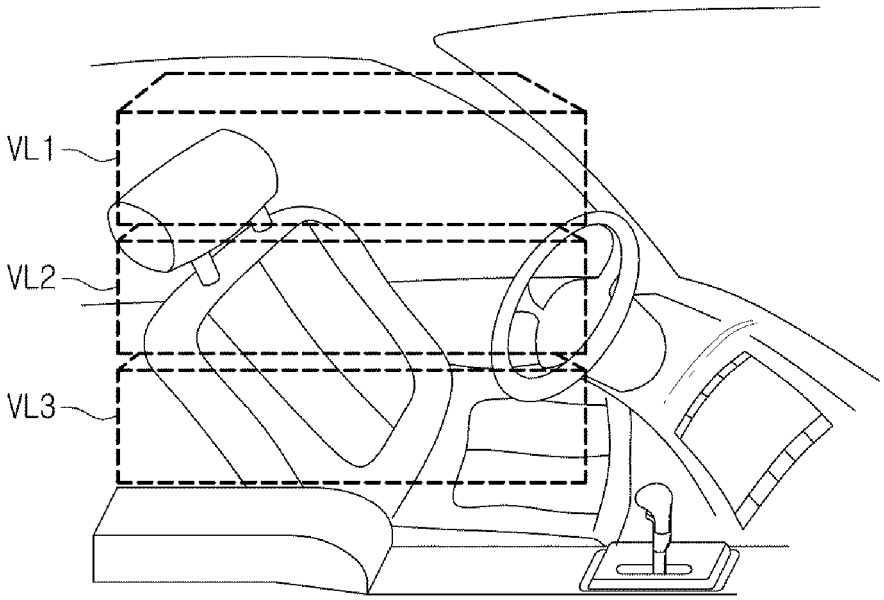
FIG. 7 is a perspective view schematically illustrating a virtual layer formed inside a vehicle in accordance with one exemplary embodiment of the present disclosure.
Figure 8:
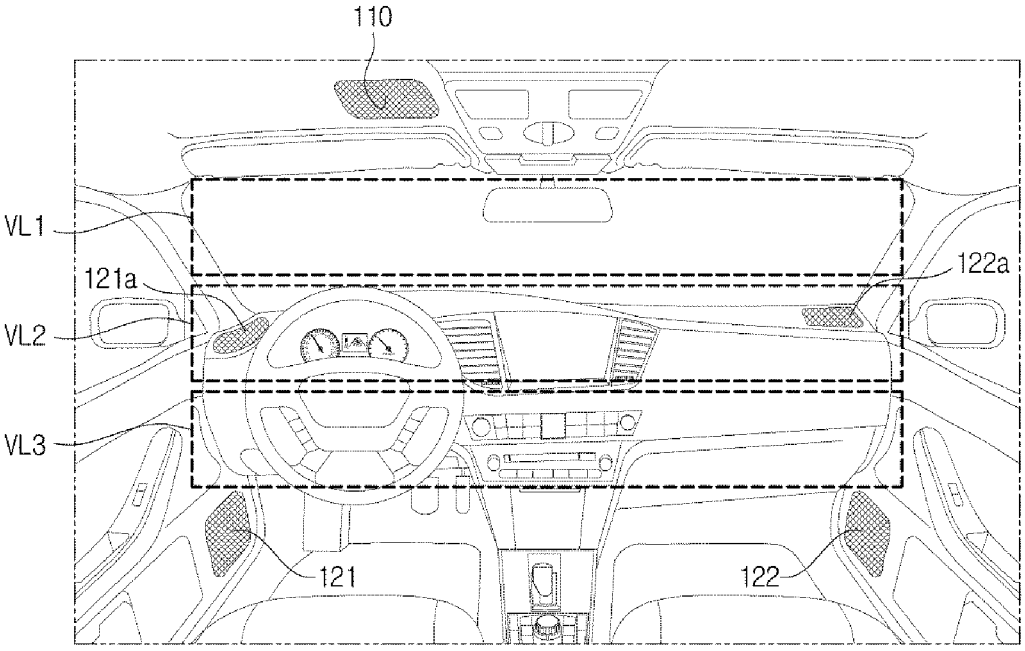
FIG. 8 is a front view schematically illustrating a virtual layer formed inside a vehicle in accordance with one exemplary embodiment of the present disclosure.

As mentioned above, the upper speaker 110 may be mounted within the vehicle 1 in accordance with one exemplary embodiment, and the sound controller 301 may be configured to divide an internal space into a plurality of virtual layers in a height direction of the vehicle 1 using the upper speaker 110. For example, as illustrated in FIGS. 7 and 8, the internal space of the vehicle 1 may be divided into three virtual layers VL1, VL2, VL3. A first virtual layer VL1 may be set to correspond to a height of driver's face, and a second virtual layer VL2 and a third virtual layer VL3 may be set to be under (e.g., below, lower than, etc.) the first virtual layer VL1, in order. However, unlike FIGS. 7 and 8, the internal space of the vehicle 1 may be divided into a greater number than three, or less number than three, hereinafter for convenience of description, the internal space of the vehicle 1 will be described to be divided into three virtual layers VL1, VL2, VL3. The sound controller 300 may be configured to provide each output object sound source, which is different from each other, via each virtual layer. The recognition of the output object sound source of the user may be increased based on such a division. Hereinafter providing a plurality of output object sound source will be described in detail.

Figure 9:
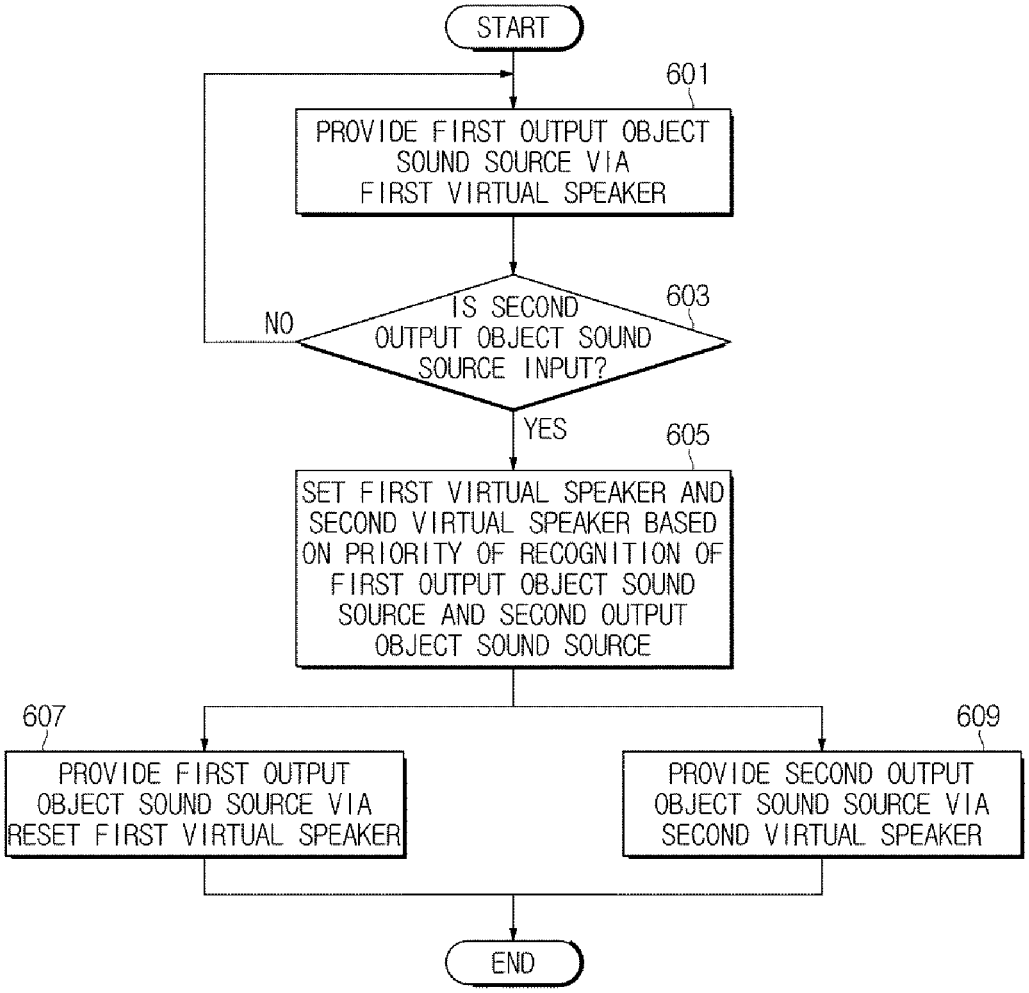
FIG. 9 is a flow chart schematically illustrating a method of providing sound of a vehicle in accordance with one exemplary embodiment of the present disclosure.
Figure 10A:
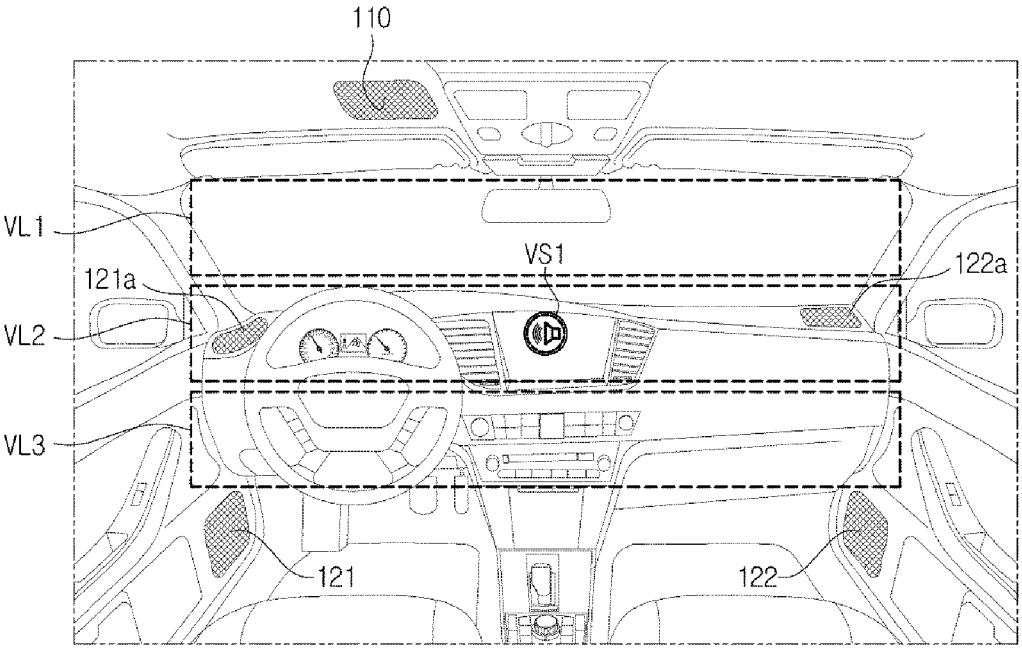
FIGS. 10A-10B are views illustrating the layer variation of virtual speaker in accordance with one exemplary embodiment of the present disclosure.
Figure 10B:
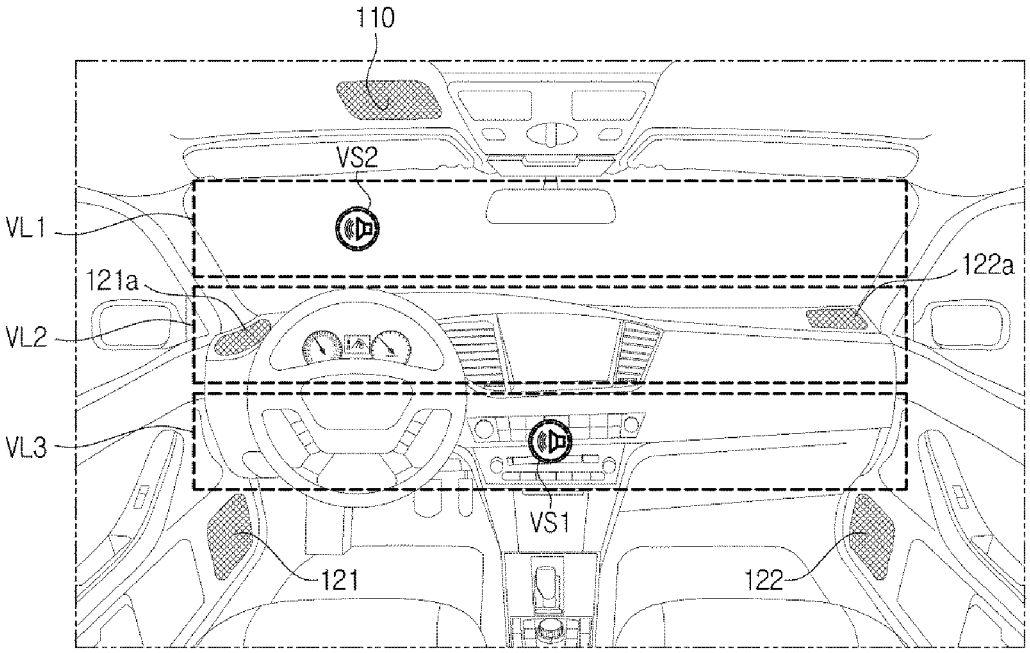

FIG. 9 is a flow chart schematically illustrating a method of providing sound of a vehicle in accordance with one exemplary embodiment of the present disclosure, and FIGS. 10A-10B are views illustrating the layer variation of virtual speaker. Referring to FIG. 9, the vehicle 1 may be configured to provide a first output object sound source via the first virtual speaker VS (601). A position of the first virtual speaker VS may be determined by a feature of the first output object sound source.

For example, when the first output object sound source is a media sound source, the first virtual speaker VS1 may be set in the second virtual layer VL2, as illustrated in FIG. 10A, to provide a rich sound to the inside of the vehicle 1. Meanwhile, when the first output object sound source is a telephone sound source, the first virtual speaker VS1 may be set in the first virtual layer VL1 that corresponds to the driver's face or head, to provide a realistic telephone sound source.

The vehicle 1 may be configured to monitor an input of a second output object sound source (603). The sound controller 300 may be configured to determine whether to input the second output object sound source, which is different from the first output object sound source. In other words, the sound controller 300 may be configured to determine whether a plurality of output object sound source is input at the same time. When the second output object sound source is input (YES of 603), the vehicle 1 may be configured to set the first virtual speaker VS1 and the second virtual speaker VS2 based on the priority of recognition of the first output object sound source and the second output object sound source (605).

The priority of recognition may be determined by the recognition importance of the driver. In other words, when an output object sound source requires immediate recognition of the driver, the output object sound source may have a high priority of recognition, and when an output object sound source does not require immediate recognition of the driver, the output object sound source may have a low priority of recognition. The priority of recognition may he set in advance. For example, according to the recognition importance, the priority of recognition may be determined particularly, a warning sound source, a telephone sound source, a guide sound source, and a medial sound source may have the priority of recognition in order, but is not limited thereto.

The priority of recognition may also be dynamically changed, for example, when an output object sound source is a warning sound source, when the risk of the warning sound source is relative low, the warning sound source may be set to be a lower than a media sound source. The sound controller 300 may be configured to compare the priority of recognition of the first output object sound source with the priority of recognition of the second output object sound source, and may be configured to set the first virtual speaker VS1 and the second virtual speaker VS2 based on the result of the comparison.

Particularly, the sound controller 300 may be configured to determine the position of first virtual speaker VS1 and the position of the second virtual speaker VS2 according to the priority of recognition. A virtual speaker VS, that provides an output object sound source having a higher priority of recognition between the first output object sound source and the second output object sound source, may be set as the, first virtual speaker VS1, and a virtual speaker VS, that provides an output object sound source having a lower priority of recognition between the first output object sound source and the second output object sound source, may be set as the second virtual speaker VS2 or the third virtual speaker VS3.

For example, as illustrated in FIG. 10A, when a media sound source is output via the first virtual speaker VS1, when a warning sound source having a higher priority of recognition than the media sound source is input, the second virtual speaker VS2 providing the warning sound source may be set in the first virtual layer VL1 and the first virtual speaker VS1 providing the media sound source may be re-set in the third virtual layer VL3. In other words, a warning sound source having a higher priority of recognition may be output in the first virtual layer VL1 that corresponds to the height of the driver's head. As mentioned above, by determining the position of the virtual speaker according to the priority of recognition, the recognition of the output object sound source of the user may be increased.

In addition, the sound controller 300 may be configured to determine a plane position of the first virtual speaker and a frequency feature of the second virtual speaker according to the priority of recognition. In the audible frequency range, the recognition of the high frequency sound may be greater than the recognition of the low frequency sound since a high pitch sound may be recognized more easily than a low pitch sound. Therefore, the sound controller 300 may be configured to set a frequency feature of the virtual speaker to output an output object, sound source having a higher priority of recognition as a high pitch sound and output an output object sound source having a lower priority of recognition as a low pitch sound.

For example, as illustrated in FIG. 10B, the first virtual speaker VS1 may be set as a high frequency to provide a high pitch sound, and the second virtual speaker VS2 may be set as a low frequency to provide a low pitch sound. As mentioned above, by changing a frequency of an output object sound source according to the priority of recognition, the recognition of the output object sound source having a higher priority of recognition may be increased.

The vehicle 1 may e configured to provide the first output object sound source via the first virtual speaker VS1, which is re-set (607), and provide the second output object sound source via the second virtual speaker VS2 (609). In other words, the vehicle 1 may be configured to provide the first output object sound source and the second output object sound source in a different height. By determining the position of the virtual speaker according to the priority of recognition, and by adjusting an output frequency of an output object sound source, the recognition of the output object sound source of the user may be increased.

Figure 11:
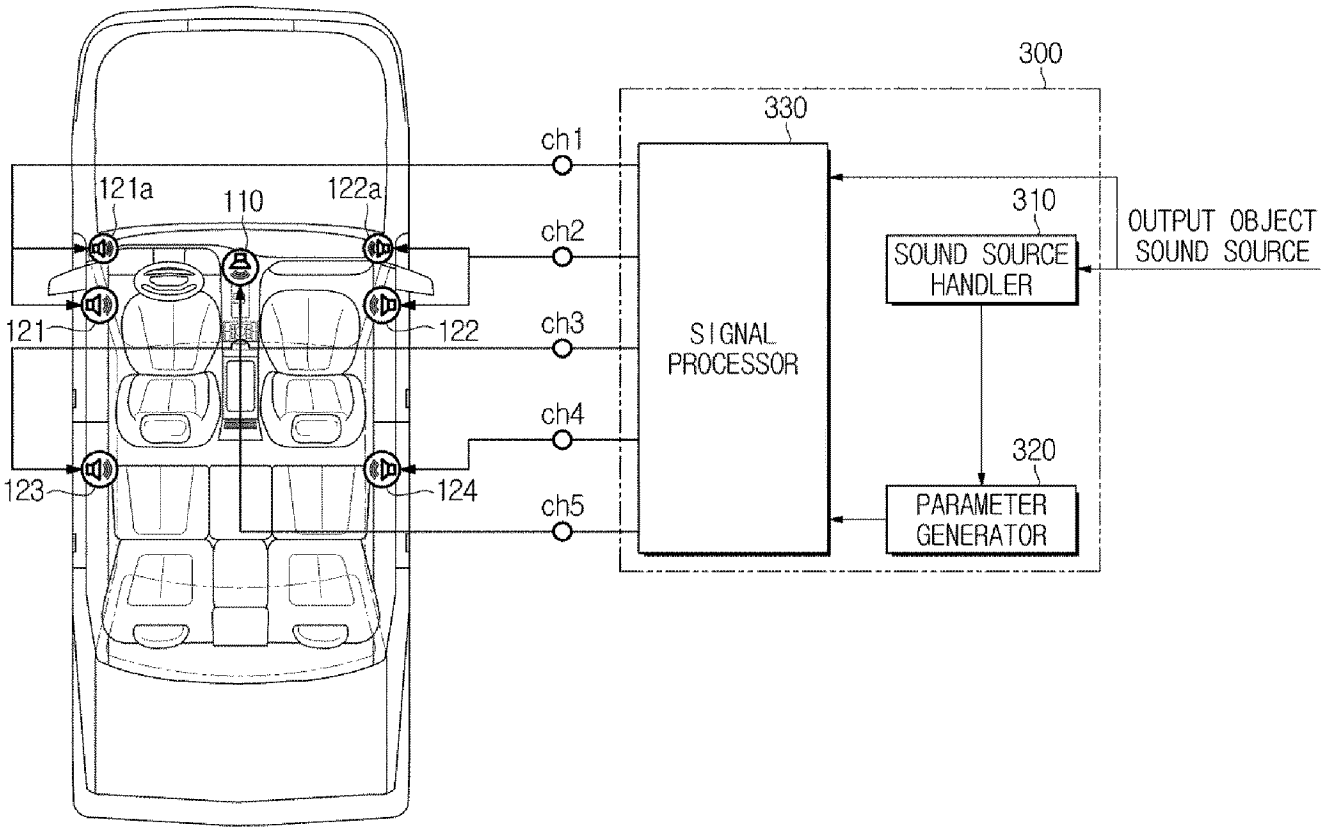
FIG. 11 is a view illustrating a sound controller in accordance with one exemplary embodiment of the present disclosure.

Hereinafter an operation of the sound controller 300 will be described in detail with reference to the drawings, FIG. 11 is a view illustrating a sound controller in accordance with one exemplary embodiment of the present disclosure. Referring to FIG. 11, the sound controller 300 may include a sound source handler 310 configured to set a virtual speaker based on an output object sound source, a parameter generator 320 configured to determine a control parameter that corresponds to the set virtual speaker, and a signal processor 330 configured to generate an audio signal, to be applied to each channel, by applying the control parameter to the output object sound source. The channel may represent a communication channel to transmit an audio signal to a speaker.

The sound source handler 310 may be configured to set a virtual speaker to which an output object sound source is supplied, based on the type of the output object sound signal. Particularly, the sound handler 310 may be configured to set at least one of a position where a virtual speaker is formed, or a frequency feature of a virtual speaker. When a single output object sound source is input, the sound source handler 310 may be configured to set a virtual speaker to transmit the single output object sound source to the driver. In contrast, when a plurality of output object sound source is input simultaneously, the sound source handler 310 may be configured to set a plurality of virtual speakers to effectively transmit the plurality of output object sound sources. Hereinafter a setting of virtual speaker will he described in detail.

Figure 12:
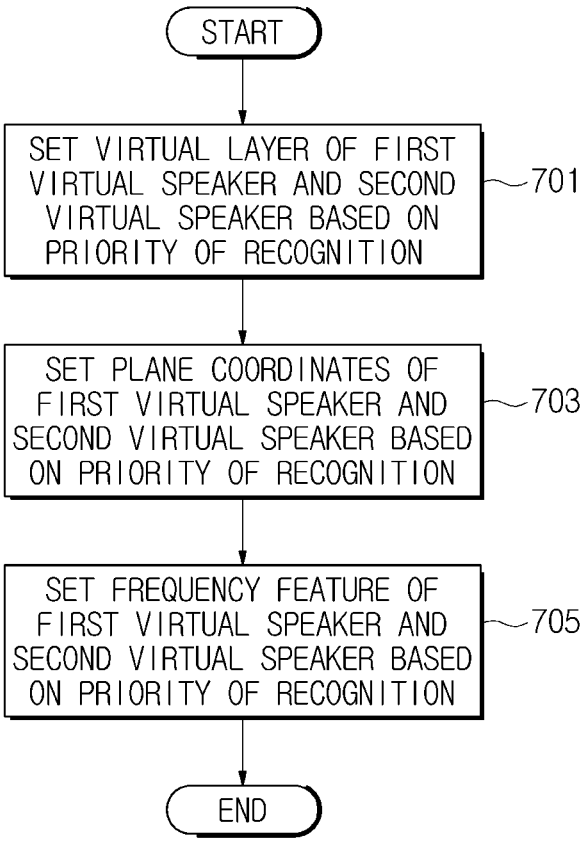
FIG. 12 is a flow chart illustrating a method of setting a virtual speaker in accordance with one exemplary embodiment of the present disclosure.
Figure 13A:
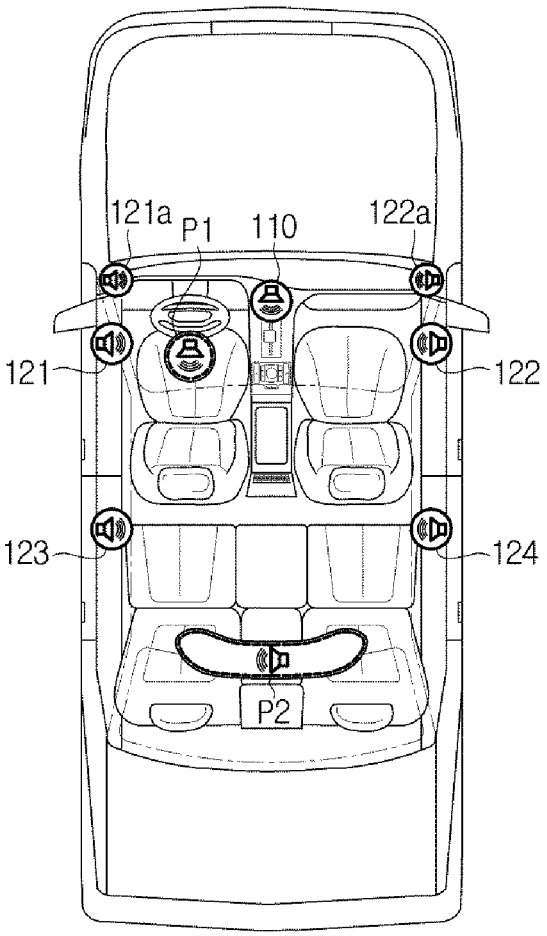
FIGS. 13A-13C are views illustrating of setting plane position of a virtual speaker in accordance with one exemplary embodiment of the present disclosure.
Figure 13B:
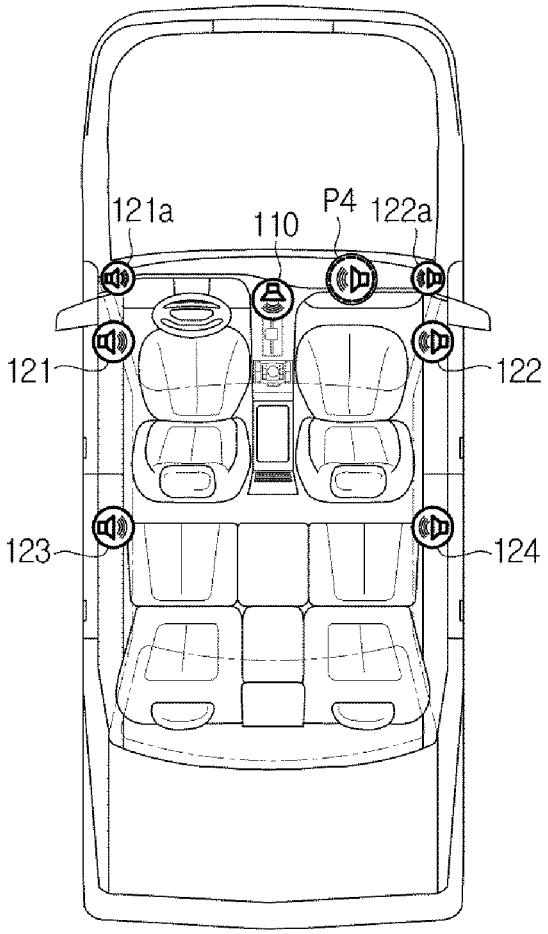
Figure 13C:
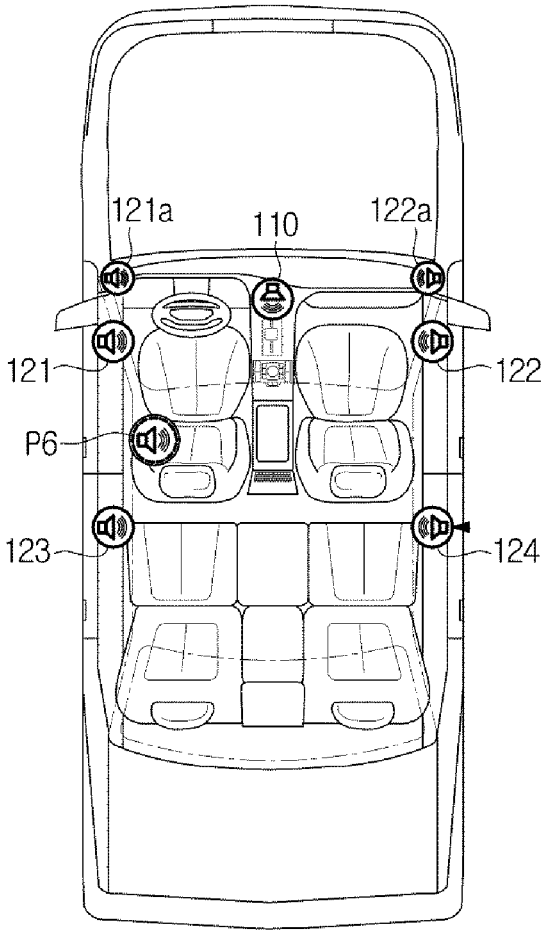
Figure 14A:
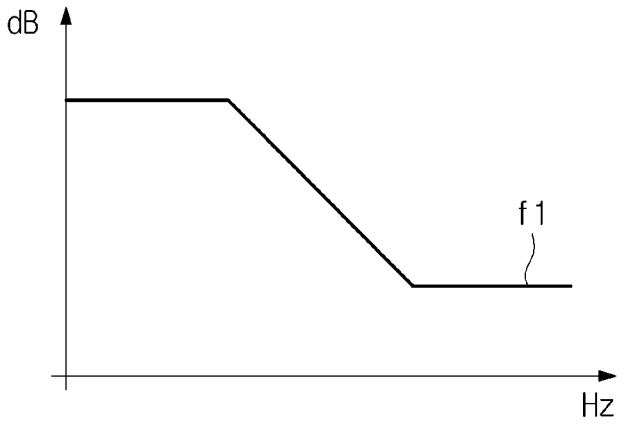
FIGS. 14A-14B are views illustrating an example of setting frequency feature of a virtual speaker in accordance with one exemplary embodiment of the present disclosure.
Figure 14B:
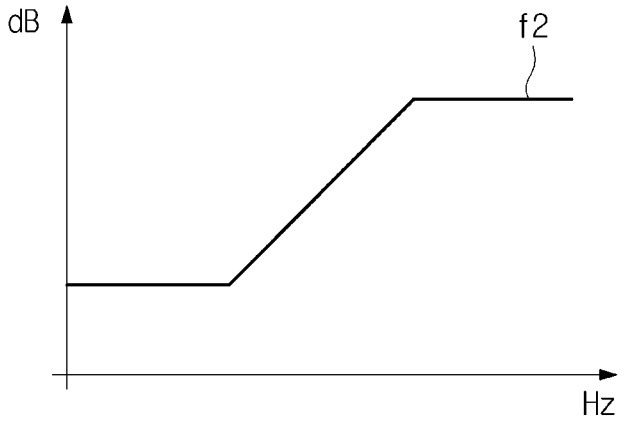

FIG. 12 is a flow chart illustrating a method of setting a virtual speaker in accordance with one exemplary embodiment of the present disclosure, FIGS. 13A-13C are views illustrating of setting plane position of a virtual speaker, and FIGS. 14A-14B are views illustrating an example of setting frequency feature of a virtual speaker. Referring to FIG. 12, the vehicle 1 may be configured to set a virtual layer of the first virtual speaker and the second virtual speaker based on the priority of recognition (701).

Further, the sound source handler 310 may be configured to set the position of the virtual speaker to be the first virtual layer VL1 to provide an output object sound source having a high priority of recognition at a height that corresponds to the driver's head, and the sound source handler 310 may be configured to set the position of the virtual speaker to be the second virtual layer VL2 or the third virtual layer VL3 to provide an output object sound source having a low priority of recognition at a height, which is separated from the driver's head (e.g., at a different height). The vehicle 1 may be configured to set a plane position of the first virtual speaker VS1 and the second virtual speaker VS2 based on the priority of recognition (703).

The sound source handler 310 may be configured to set a plane position of the virtual speaker to provide an output object sound source having a high priority of recognition in a position proximate to the driver. For example, the sound source handler 310 may be configured to determine a position of the virtual speaker to he adjacent to the driver seat (P1), as illustrated in FIG. 13A. The sound source handler 310 may be configured to set a plane position of the virtual speaker to provide an output object sound source having a low priority of recognition in a position separated from the driver. For example, the sound source handler 310 may be configured to determine a position of the virtual speaker to be separated from the driver seat (P2), as illustrated in FIG. 13A.

Meanwhile, the sound source handler 310 may configure to set a plane position based on a feature of an output object sound source. For example, when an output object sound source is a guidance sound source guiding the vehicle 1 to turn left, as illustrated in FIG. 4A, the sound source handler 310 may be configured to set plane coordinates of the virtual speaker to be a position that corresponds to the front right of the driver seat (P4), as illustrated in FIG. 13B. When an output object sound source is a warning sound source providing a warning notification that another vehicle is present in the back left of the vehicle 1, as illustrated in FIG. 513, the sound source handler 310 may he configured to set plane coordinates of the virtual speaker to be a position that corresponds to the back left of the driver seat (P6), as illustrated in FIG. 13C.

The vehicle 1 may be configured to set a frequency feature of the first virtual speaker and the second virtual speaker based on the priority of recognition (705). As mentioned above, the recognition of the high pitch sound may be greater than that of the low pitch sound. Therefore, the sound source handler 310 may be configured to determine a frequency feature of the output object sound source based on the priority of reconition. Particularly, the sound source handler 310 may be configured to set the virtual speaker to allow an output object, sound source having a low priority of recognition to have a frequency feature (f1), as illustrated in FIG. 14A. In other words, when an output object sound source has a low priority of recognition, the sound source handler 310 may be configured to set a frequency feature of the virtual speaker in a way that a low pitch sound is strongly output and a high pitch sound is weakly output.

In contrast, the sound source handler 310 may be configured to set the virtual speaker to allow an output object sound source having a high priority of recognition to have a frequency feature (f2), as illustrated in FIG. 14B. In other words, when an output object sound source has a high priority of recognition, the sound source handler 310 may be configured to set a frequency feature of the virtual speaker in a way that a low pitch sound is weakly output and a high pitch sound is strongly output.

As mentioned above, by setting frequency features of virtual speakers, which is different from each other, to be crossed, the recognition of the plurality of output object sound sources may be improved. The parameter generator 320 may be configured to determine a parameter to be applied to an output object sound source based on the virtual speaker determined by the sound source handler 310. Particularly, the parameter generator 320 may be configured to determine a channel to which an audio signal is input, time shifting variation configured to adjust an input of the audio signal of each channel, gain variation configured to adjust the size of output object sound source, and frequency variation. The parameter generator 320 may further be configured to determine a channel to which an audio signal is output based on the set position of the virtual speaker. In other words, the parameter generator 320 may be configured to determine which speaker 100 is supplied with an audio signal based on the set position of the virtual speaker.

Figure 15A:
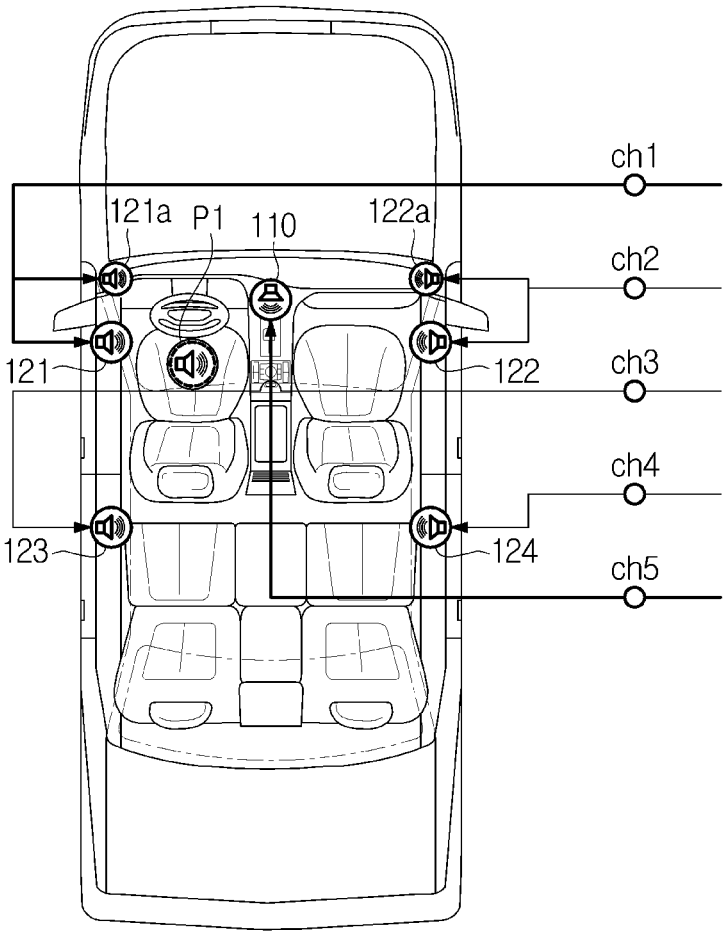
FIGS. 15A-15D are views illustrating of selecting a output channel when a virtual speaker is placed in a first virtual layer in accordance with one exemplary embodiment of the present disclosure.
Figure 15B:
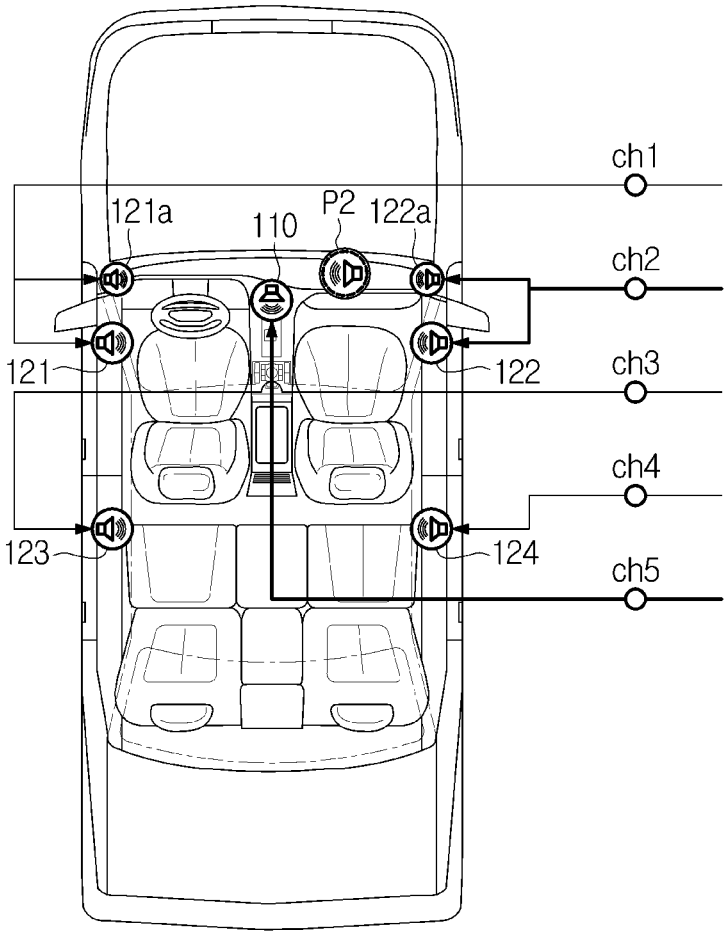

FIGS. 15A-15D are views illustrating of selecting a output channel when a virtual speaker is placed in a first virtual layer. As illustrated in FIG. 15A, when the virtual speaker is set to the first position (P1) adjacent to the driver seat, an audio signal may be applied to the first lower speaker 121, the first sub-speaker 121*a*, and the upper speaker 110, all of which are adjacent to the first position (P1). In other words, the parameter generator 320 may determine a first channel (ch1) corresponding to the first lower speaker 121 and the first sub-speaker 121*a*, and a fifth channel (ch5) that corresponds to the upper speaker 110 to be a channel to output an audio signal.

As illustrated in FIG. 1513, when the virtual speaker is set to the second position (P2) adjacent to the passenger seat, an audio signal may be applied to the second lower speaker 122, the second sub-speaker 121*b*, and the upper speaker 110, all of which are adjacent to the second position (P2). In other words, the parameter generator 320 may be configured to determine a second channel (ch2) that corresponds to the second lower speaker 122 and the second sub-speaker 121*b*, and the fifth channel (ch5) corresponding to the upper speaker 110 to be a channel to output an audio signal.

Figure 15C:
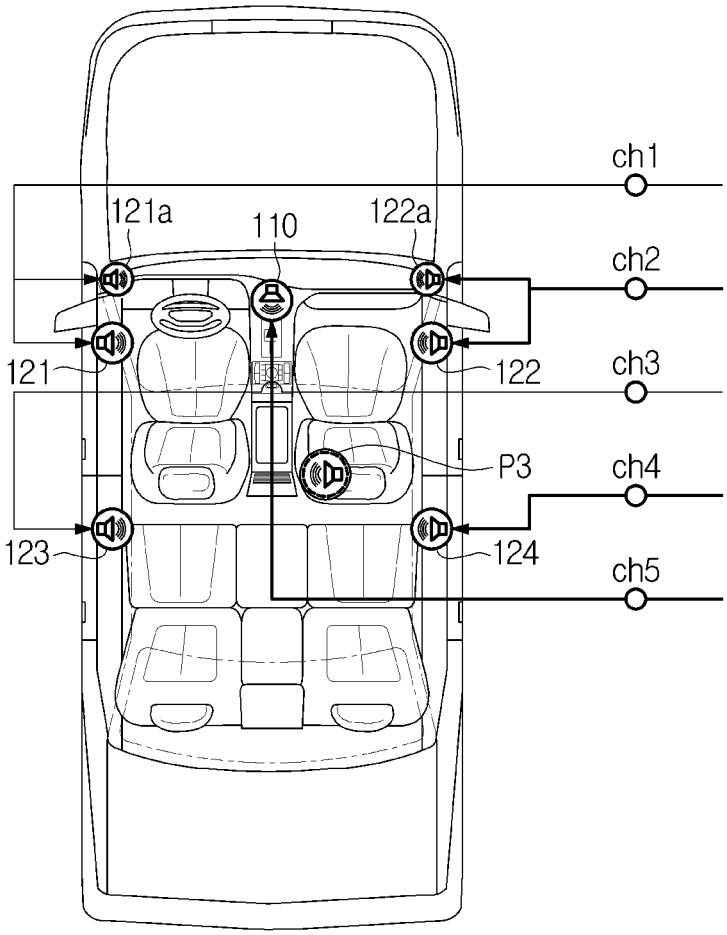

As illustrated in FIG. 15C, when the virtual speaker is set to the third position (P3) adjacent to a center console, an audio signal may be applied to the second lower speaker the second sub-speaker 121*b*, the fourth lower speaker 124 and the upper speaker 110, all of which are adjacent to the third position (P3). In oilier words, the parameter generator 320 may be configured to determine the second channel (ch2.) that corresponds to the second lower speaker 122 and the second sub-speaker 121*a* and 121*b*, a fourth channel (ch4) that corresponds to the fourth lower speaker 124, and the fifth channel (ch5) that corresponds to the upper speaker 110 to be a channel to output an audio signal.

Figure 15D:
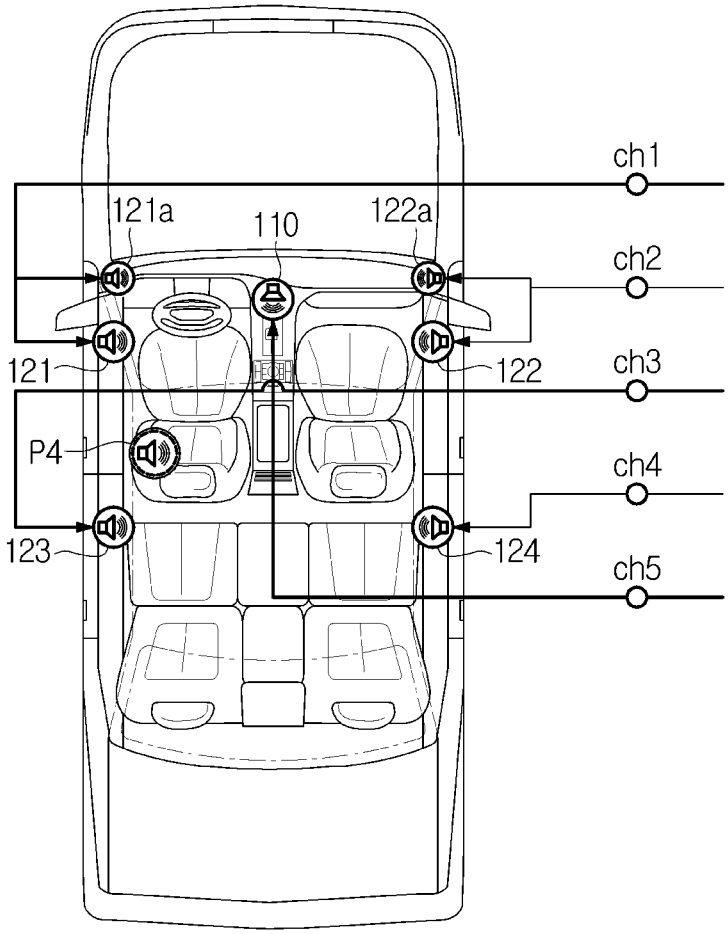

As illustrated in FIG. 15D, when the virtual speaker is set to the fourth position (P4) adjacent to the back of the driver seat, an audio signal may be applied to the first lower speaker 121, the first sub-speaker 121*a*, the third lower speaker 123 and the upper speaker 110, all of which are adjacent to the fourth position (P4). In other words, the parameter generator 320 may be configured to determine the second channel (ch2) that corresponds to the first lower speaker 121 and the second sub-speaker 121*a* and 121*b* the fourth channel (ch4) that corresponds to the fourth lower speaker 124, and the fifth channel (ch5) that corresponds to the upper speaker 110 to be a channel to output an audio signal.

When the position of the virtual speaker is set to the second virtual layer VL2 or the third virtual layer VL3, an audio signal may be not input to the upper speaker 110. In other words, when the virtual speaker is set to the second virtual layer VL2 and the third virtual layer VL3, an audio signal may be applied to from the first channel (ch1) to the fourth channel (ch4). In addition, the parameter generator 320 may be configured to determine time shifting variation and gain variation, both of which may be applied to an output object sound source. To form the virtual speaker VS in the set position, timing of output an audio signal output via each speaker 100 may be adjusted. The parameter generator 320 may be configured to determine time shifting variation to adjust the timing of output an audio signal that corresponds to each channel, based on a distance between each speaker 100 and the virtual speaker VS.

In addition, to form the virtual speaker VS in the set position, the size of output object sound source output via each speaker 100 may be adjusted. The parameter generator 320 may be configured to determine gain variation to adjust the output size, based on a distance between each speaker 100 and the virtual speaker VS. The parameter generator 320 may further be configured to determine frequency variation applied to an output object sound source. To form the virtual speaker VS, a distance between the speaker 100 and the virtual speaker may be applied after being converted into a frequency. The parameter generator 320 may be configured to determine frequency variation that corresponds to a distance between each speaker 100 and the virtual speaker VS.

FIG. 16 is a view illustrating an example of a parameter lookup table. The parameter generator 320 may be configured to individually determine a parameter based on the position of the virtual speaker 100, but the parameter generator 320 may be configured to rapidly estimate a variation to be applied to an output object sound source by using a look up table in which gain variation (k) and frequency variation (θ) are pre-determined based on the position of the virtual speaker, as illustrated in FIG. 16.

As mentioned above, since the position of the first virtual speaker to which the first output object sound source is provided, and the position of the second virtual speaker to which the second output object sound source is provided are different from each other, the parameter generator 320 may be configured to individually estimate a variation that corresponds to the first virtual speaker and a variation that corresponds to the second virtual speaker. The signal processor 330 may be configured to apply a variation estimated by the parameter generator 320 to the output object sound source, and then generate an audio signal to be input to a plurality of channels. An audio single to be provided to each channel may be defined by the following equation 1.

$$S^n(t, f) = k_n \cdot A(t) \cdot e^{j \cdot 2\pi\left(\left(1 + \frac{\Theta_n}{c}\right) \cdot f\right) \cdot t} \qquad \text{Equation 1}$$

wherein, S may represent an audio signal, n may represent a channel of the speaker 100, t may represent an output time of an audio signal A may represent the size of an output object sound source to be provided via the virtual speaker, f may represent a frequency of an output object sound source to be provided via the virtual speaker, c may represent the speed of sound when air is the medium k may represent gain variation to adjust a gain of audio signal based on a distance between the virtual speaker and each speaker, and θ may represent frequency variation to adjust a frequency of audio signal based on a distance between the virtual speaker and each speaker.

As illustrated in the equation 1, the signal processor 330 may be configured to generate an audio signal (S) by applying a gain variation (k) and a frequency variation (θ) by each channel. An output timing of the audio signal (S), which is generated by each channel, may be determined by the time shifting variation.

Meanwhile, when a plurality of output object sound source is present, the signal processor 330 may be configured to generate an audio signal that corresponds to each output object sound signal, respectively, may be configured to composite the generated audio signal, and may be configured to output the composited (e.g., combined) audio signal to each channel. Particularly, the signal processor 330 may be configured to generate a first audio signal that corresponds to the first output object sound signal and a second audio signal that corresponds to the firs(output object sound signal, may be configured to composite the first audio signal and the second audio signal, both of which have the same output timing, and may be configured to output the composited audio signal to each channel.

As mentioned above, the frequency feature of the first virtual speaker and the frequency feature of the second virtual speaker may be set to be different from each other according to the priority of recognition. Therefore, the signal processor may be configured to filter the generated audio signal and then output the audio signal to provide an output object sound source according to the set frequency feature. For example, by applying a filter, as illustrated in FIG. 14B, to a signal that corresponds to an output object sound source having a high priority of recognition, a high pitch sound may be emphasized, and by applying a filter, as illustrated in FIG. 14A, to a signal that corresponds to an output object sound source having a low priority of recognition, a low pitch sound may be emphasized.

Furthermore, when an output object sound source is composited by a repetitive beep sound, e.g., a warning sound source to provide a notification regarding the risk of the collision during parking, the parameter generator 320 may be configured to set a repetition period of beep sound based on the priority of recognition of the output object sound source. The signal processor may be configured to generate an audio signal of each channel using a repetition period, which is set using the following Equation 2.

$$S^n(t, f) = k_n \cdot A(t) \cdot e^{j \cdot 2\pi\left(\left(1 + \frac{\Theta_n}{c}\right) \cdot f\right) \cdot (t^* T_n)} \qquad \text{Equation 2}$$

wherein, S may represent an audio signal, n may represent a channel of the speaker 100, t may represent an output time of an audio signal, A may represent the size of an output object sound source to be provided via the virtual speaker, f may represent a frequency of an output object sound source to be provided via the virtual speaker, c may represent the speed of sound when air is the medium, k may represent gain variation to adjust a gain of audio signal based on a distance between the virtual speaker and each speaker, θ may represent frequency variation to adjust a frequency of audio signal based on a distance between the virtual speaker and each speaker, and T may represent a repetition period of beep sound.

Figure 17:
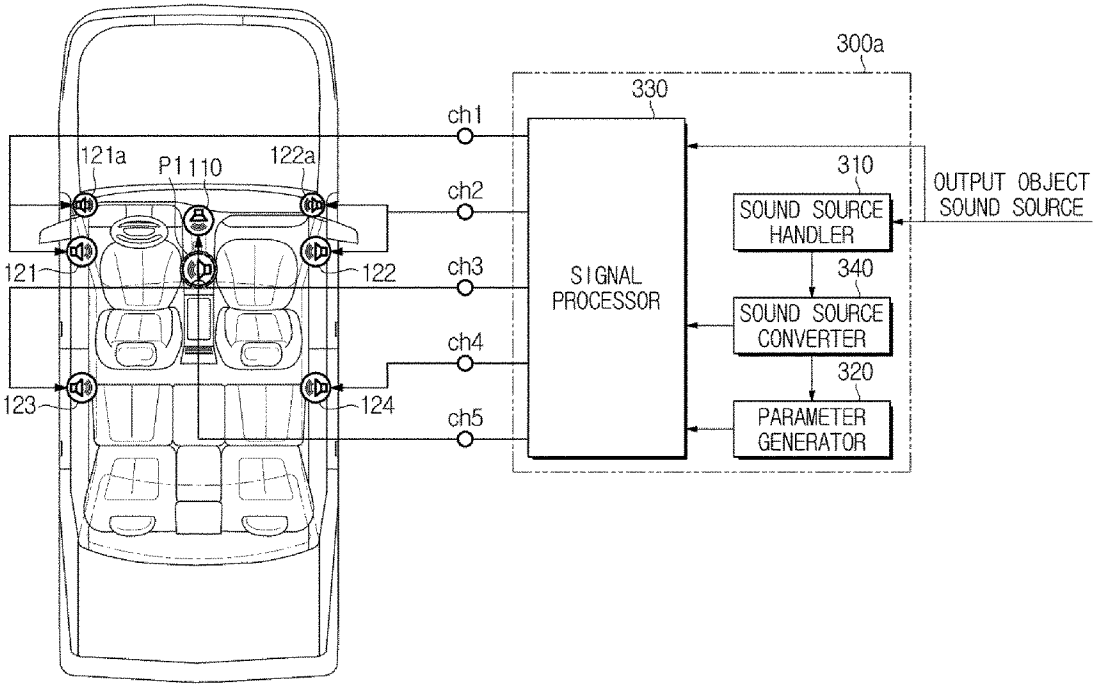
FIG. 17 is a view illustrating a sound controller in accordance with another exemplary embodiment of the present disclosure.
Figure 18:
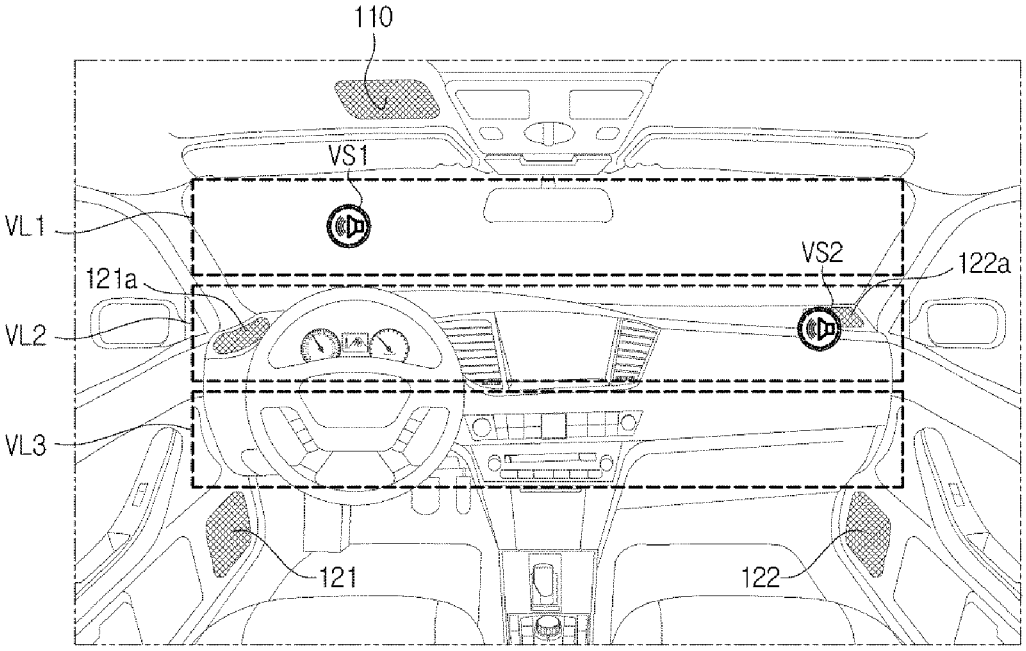
FIG. 18 is a view illustrating the conversion of output object sound source by a sound source converter.

FIG. 17 is a view illustrating a sound controller in accordance with another embodiment of the present disclosure and FIG. 18 is a view illustrating the conversion of output object sound source by a sound source converter. Hereinafter for convenience of description, the same configuration as the sound controller 300 may have the same reference numeral, and a description (hereof will be omitted.

A sound controller 300 in accordance with another exemplary embodiment of the present disclosure may further include a sound source converter 340. The sound source converter 340 may be configured to convert an output object sound source to be input into a beep sound to prevent the collision between output object sound sources. Particularly, when a first output object sound source a having high priority of recognition is provided, when a second output object sound source having a lower priority of recognition than that of the first output object sound source is input, the sound source converter 340 may be configured to convert the second output object sound source into a beep sound, and provide the beep sound.

For example, when a driver is using the telephone via a hands-free operation, when a guidance sound source is output, the driver's telephone call may be interfered. Therefore, the sound source converter 340 may be configured to convert the guidance sound source into a beep sound to prevent an interruption to the telephone call. In other words, as illustrated in FIG. 18, the telephone sound source may be continuously provided via the first virtual speaker, the guidance sound source may be converted into a beep sound and then output via the second virtual speaker VS2 formed in the second virtual layer VL2.

Figure 19:
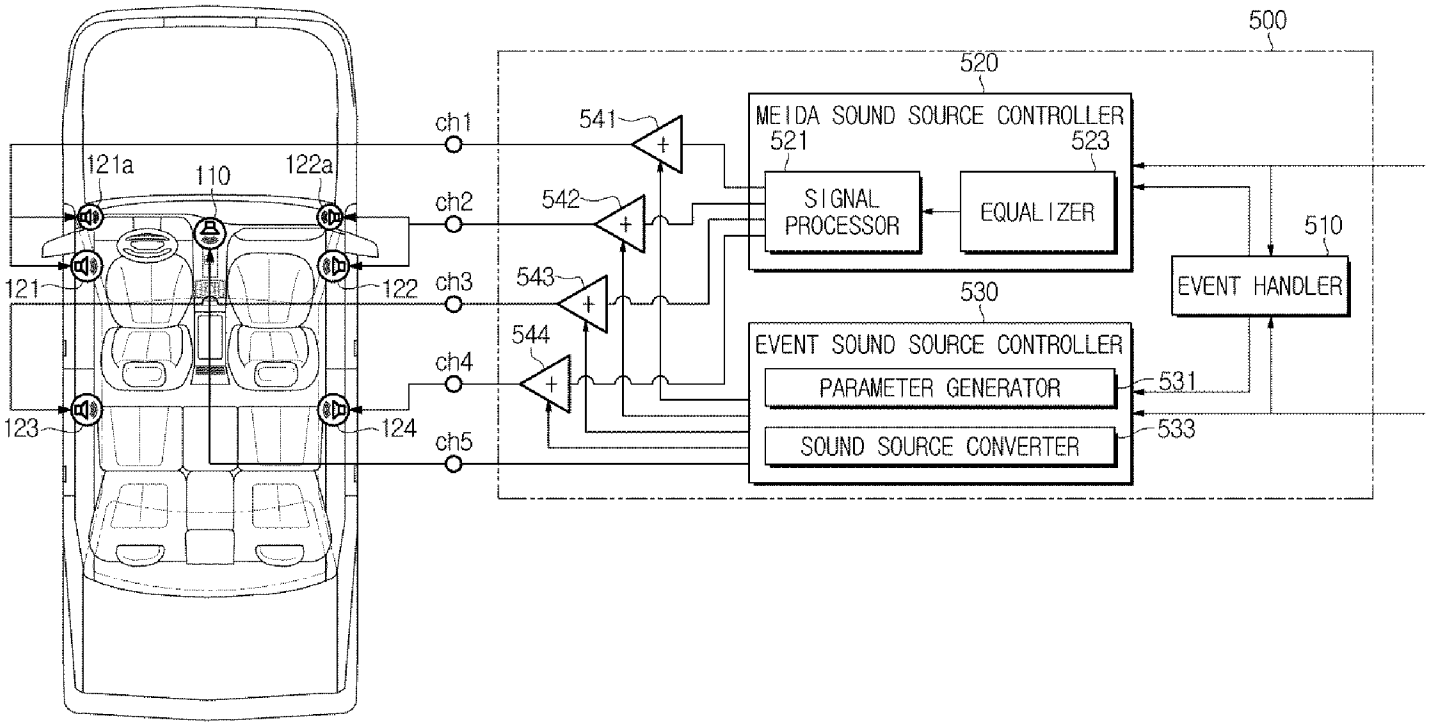
FIG. 19 is a view illustrating a sound controller in accordance with another exemplary embodiment of the present disclosure.
Figure 20A:
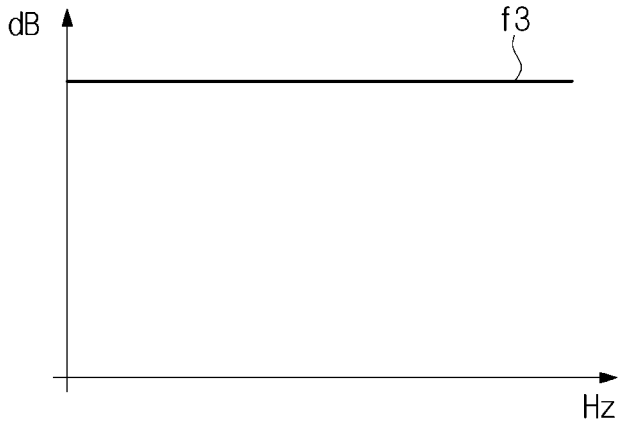
FIGS. 20A-20D are views illustrating a frequency filtering by an equalizer in accordance with one exemplary embodiment of the present disclosure.
Figure 20B:
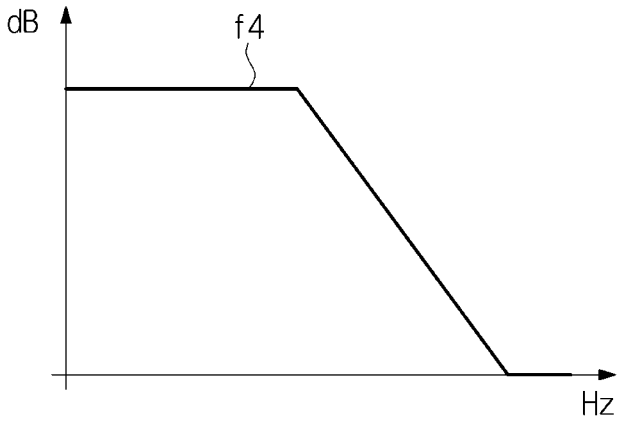
Figure 20C:
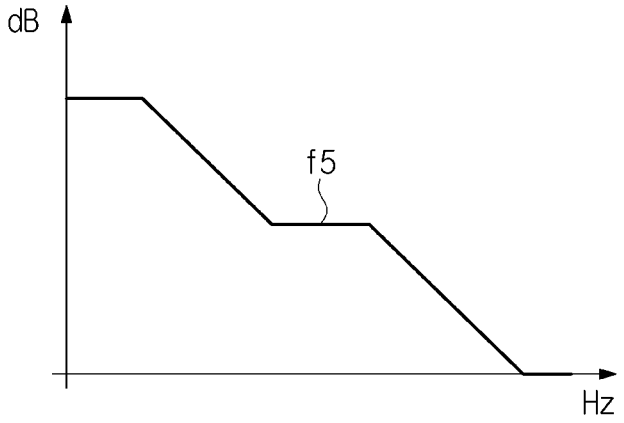
Figure 20D:
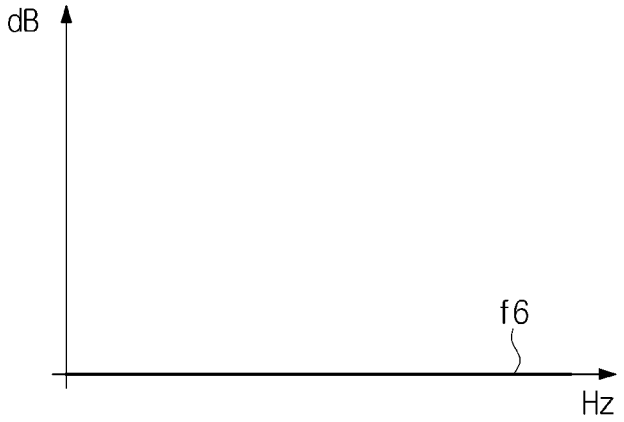
Figure 21A:
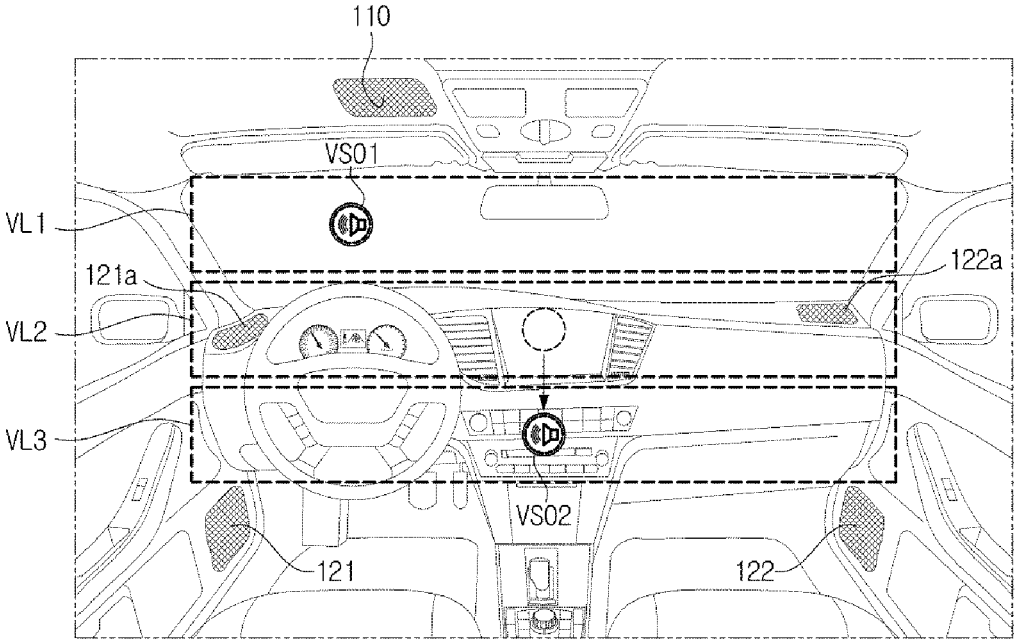
FIGS. 21A-21B are views illustrating the position variation of a virtual speaker in accordance with one exemplary embodiment of the present disclosure.
Figure 21B:
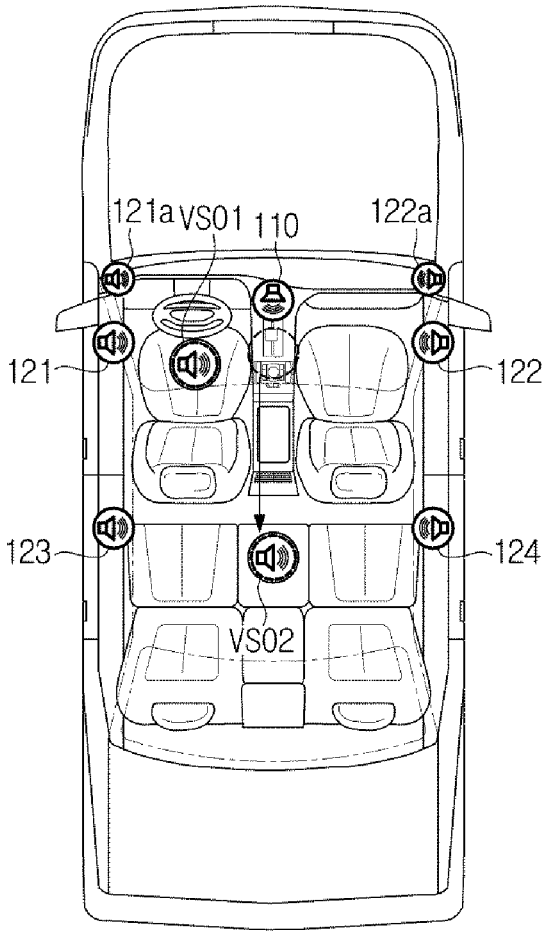
Figure 22:
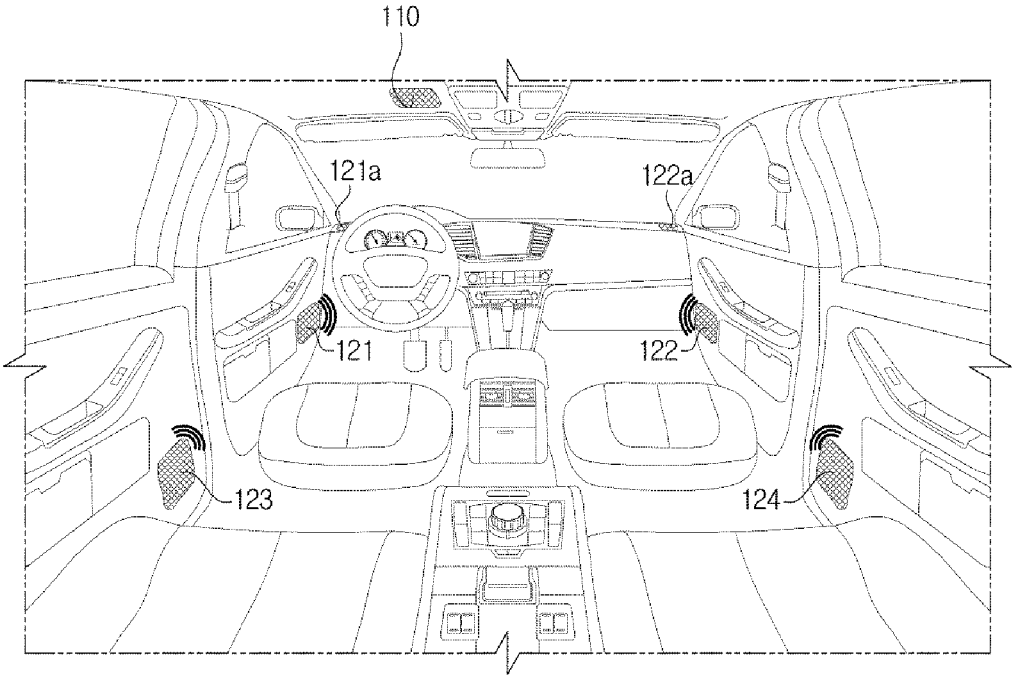
FIG. 22 is a view illustrating an operation of a speaker when a media sound source, in which a low sound area is removed, is provided in accordance with one exemplary embodiment of the present disclosure.
Figure 23:
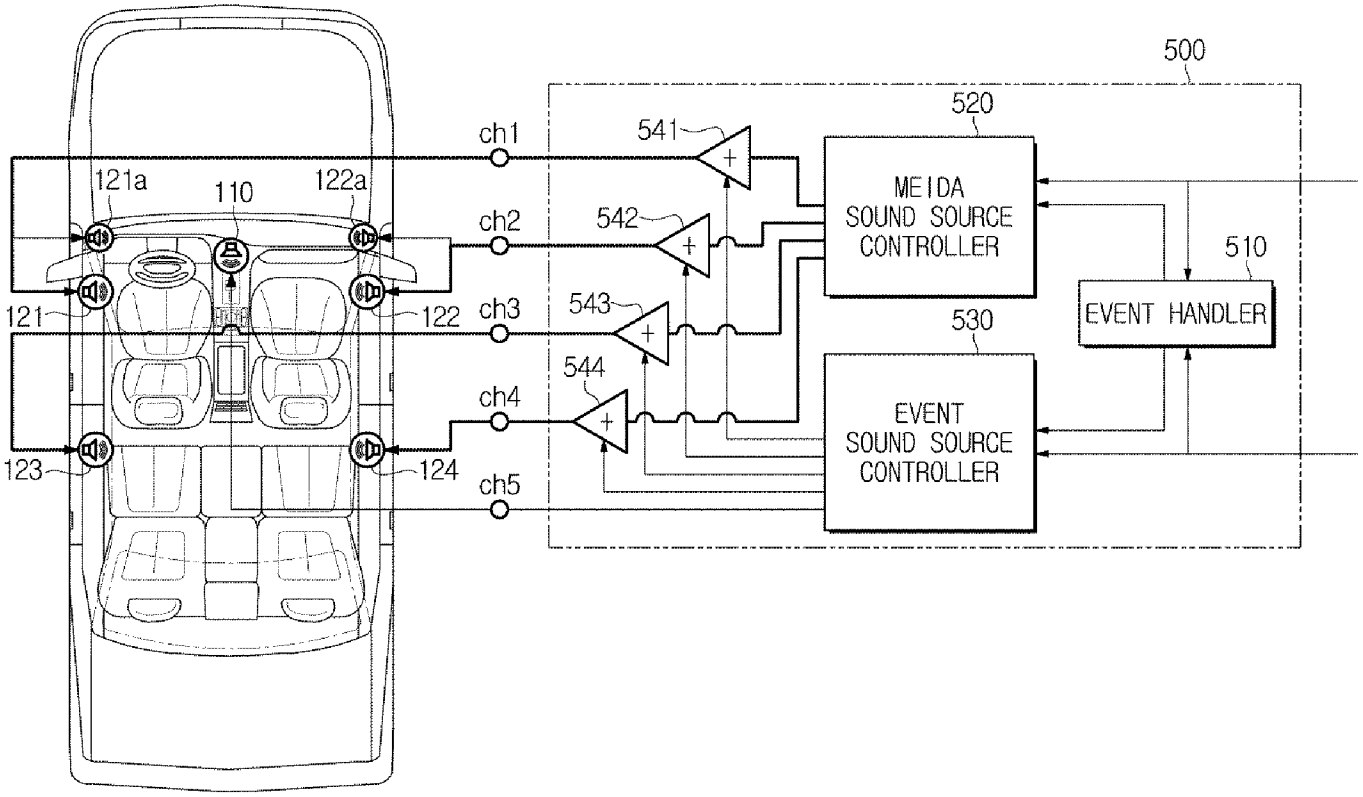
FIG. 23 is a view illustrating of outputting an audio signal when a media sound source, in which a low sound area is removed, is provided in accordance with one exemplary embodiment of the present disclosure.
Figure 24:
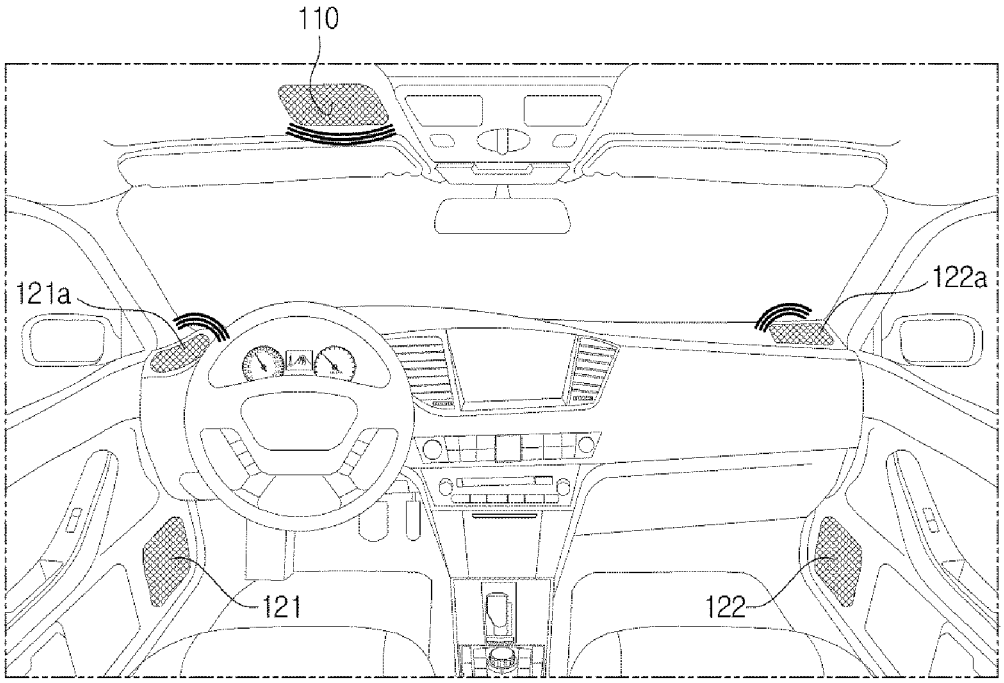
FIG. 24 is a view illustrating a virtual speaker position when a plurality of event sounds is input in accordance with one exemplary embodiment of the present disclosure.

FIG. 19 is a view illustrating a sound controller in accordance with another embodiment of the present disclosure FIGS. 20A-20D are views illustrating a frequency filtering by an equalizer and FIGS. 21A-21B are views illustrating the position variation of a virtual speaker. FIG. 22 is a view illustrating an operation of a speaker when a media sound source, in which a low sound area is removed, is provided, FIG. 23 is a view illustrating of outputting an audio signal when a media sound source, in which a low sound area is removed, is provided, and FIG. 24 is a view illustrating a virtual speaker position when a plurality of event sounds is input. Referring to FIG. 19, a sound controller 500 in accordance with another exemplary embodiment of the present disclosure may include an event handler 510, a media sound source controller 520, and an event sound source controller 530.

Hereinafter an output object sound source will be described to be divided into a media sound source and an event sound source. The event sound source may represent an output object sound source, which is not continuously provided, in comparison with the media sound source, and the event sound source may be any one of a warning sound source, a phone sound source, and a guide sound source. The media sound source controller 520 may be configured to output an audio signal that corresponds to a media sound source. The media sound source controller 520 may include a signal processor 521 and an equalizer 523.

In particular, the equalizer 523 may be configured to correct and improve the quality of media sound source, and may be configured to change a frequency feature of the media sound source. Particularly, the equalizer 523 may emphasize a particular frequency band of the medial sound source, or reduce the particular frequency band of the medial sound source. For example, the equalizer 523 may operate as an all pass filter (f3) configured to pass all of input media sound source, as illustrated in FIG. 20A, operate as a low pass filter (f4, f5) configured to pass a low frequency band among the media sound source, as illustrated in FIG. 20B, or operate as a filter (f6) configured to block all frequency band, as illustrated in FIG. 20D.

The signal processor 521 may be configured to generate an audio signal by processing a media sound source, in which a frequency feature thereof is changed by the equalizer 523. The signal processor 521 may further be configured to generate an audio signal for each channel to provide the media sound source via the virtual speaker. For example, the signal processor 521 may be configured to generate an audio signal to be input to each channel, using the above-mentioned equation 1.

Referring to FIG. 19, again, the event handler 510 may be configured to monitor an input of the event sound source. When the event sound source is input via the data bus 270, the event handler 510 may be configured set a virtual speaker to provide an event sound source. The virtual speaker VS to provide the event sound source, may be set in the first virtual layer VI, that corresponds to the height of the driver's head, as mentioned above, and thus the event sound source may be delivered to the driver more clearly.

In addition, in order that the driver could more clearly recognize the event source, plane coordinates of the event sound source may be set based on a feature of the event soured source. For example, plane coordinates of an event sound source to guide right turning of the vehicle 1 may be set to the front right of the driver seat, and plane coordinates of an event sound source, which is to provide a notification that another vehicle is disposed in the back left of the vehicle 1, may be set to the back left of the driver seat. When an event sound source is input, the event handler 510 may be configured to change a position of the virtual speaker configured to provide a media sound source. Particularly, the event handler 510 may be configured to change the position of the virtual speaker, which is configured to provide an event sound source to the second virtual layer VL2 or the third virtual layer VL3, to provide the event sound source and the medial sound source in a separated space.

For example, as illustrated in FIG. 20A, the event handler 510 may be configured to set the first virtual speaker VS01, which is configured to provide an event sound source, to the first virtual layer VL1, and may be configured to change the position of the second virtual speaker VS02, which is configured to provide a media sound source, to the third virtual layer VL. In addition, as illustrated in FIG. 20B, the event handler 510 may be configured to move plane coordinates of the second virtual speaker VS02, which is configured to provide a media sound source, to backward. When an event sound source is input, the event handler 510 may be configured to transmit a control command to the equalizer 523 to change a frequency feature of the medial sound source. When the control command is transmitted, the equalizer 523 may be configured to change a frequency feature of media sound source based on the control command. Particularly, the equalize 523 may be configured to pass a low frequency band among the media sound source using the low pass filter (f4), as illustrated in FIG. 20B.

As mentioned above, when a high frequency band is filtered by the equalizer 523, a component in a low frequency band among the media sound source may be input to the signal processor 521, and thus only a signal in the low pitch sound may be applied to the speaker. As mentioned above, the sub-speaker 121*a* and 121*b* disposed on the dashboard 40 may be configured to output a high pitch sound, and thus the sub-speaker 121*a* and 121*b* may not output sound. Therefore, only the lower speaker 120 may be configured to output media, as illustrated in FIG. 22. In other words, when a high pitch sound is removed by the equalizer 523, there may be an effect that the media sound source is provided to only the lower speaker 120, as illustrated in FIG. 23, and thus the virtual layer of the virtual speaker of the media sound source may be lowered.

The event sound source controller 530 may be configured to provide an event sound source input via a virtual speaker set by the event handler 510. Particularly, the event sound source controller 530 may be configured to determine a channel, to which an audio signal that corresponds to an event sound source is output, using the above-mentioned parameter generator 320, and may be configured to estimate time shifting variation, gain variation, and frequency variation for each channel. The event sound source controller 530 may be configured to generate an audio signal by applying a variation, acquired by the parameter generator 320, to an event sound source, and then may be configured to output the audio signal. Particularly, the audio signal may be generated by the above-mentioned equation 1, but a method of generating an audio signal is not limited thereto. In addition, the event handler 510 may be configured to set a frequency feature of the virtual speaker to change a frequency feature of an input event sound source. In other words, the event handler 510 may be configured to set the frequency of the virtual speaker in a way that a high pitch sound of the input event sound source may be emphasized.

Meanwhile, when the input event sound source is a beep sound, the sound controller 500 may be configured to determine a repetition period of the beep sound according to the priority of recognition of the event sound source, and then may be configured to generate an audio signal using the above-mentioned equation 2. The sound controller 500 may further include a composition unit. The composition unit may be disposed between the media sound source controller 520 and the lower speaker 120. The composition unit may be configured to composite (e.g., combine) an audio signal output by the media sound source controller 520, and an audio signal output by the event sound source controller 530, and then output the composited audio signal.

Hereinbefore a case in which a single event sound source is input is described, but a plurality of event sound sources may be input at the same time, particularly, a guidance sound source or a warning sound source is input while a telephone sound source is input. When the plurality of event sound sources are generated, the event handler 510 may be configured to determine a position of a virtual speaker configured to provide an event sound source, based on the priority of recognition between the plurality of event sound sources, as the same as the above-mentioned sound source handler 310.

Particularly, the event handler 510 ray be configured to set a position of a virtual speaker, which is configured to provide an event sound source having a high priority of recognition among the plurality of event sound sources, as the first virtual layer, and may be configured to set a position of a virtual speaker, which is configured to provide an event sound source having a low priority of recognition, as the second virtual layer. For example, as illustrated in FIG. 24, when a telephone sound source and a path guidance sound source of the navigator 220 are input simultaneously, a virtual speaker VS01 configured to provide the telephone sound source having the highest priority of recognition may be set to a position that corresponds to the driver seat in the first virtual layer VL1, a virtual speaker VS02 configured to provide the guidance sound source having a low priority of recognition may be set to a position in the second virtual layer VL2, and a virtual speaker VS03 configured to provide the media sound source may be set to a position in the third virtual layer VL3. In addition, when a plurality of event sound sources is input, the equalizer 523 may be configured to pass only a lower frequency in the media sound source, as illustrated in FIG. 20C and thus the recognition of the event sound source may be improved.

Meanwhile, when three and more event sound source are input, the equalizer 523 may be configured to block all frequency bands in the media sound source, as illustrated in FIG. 20D. FIGS. 25A-25B and 26A-26B are views illustrating a dynamic allocation of a virtual layer. FIGS. 27 and 28A-28C illustrate that the vehicle 1 is divided into three layers, but a virtual layer VL may be dynamically divided. Hereinafter a description thereof will be described with reference to FIGS. 25A-25B and 26A-26B.

Figure 25A:
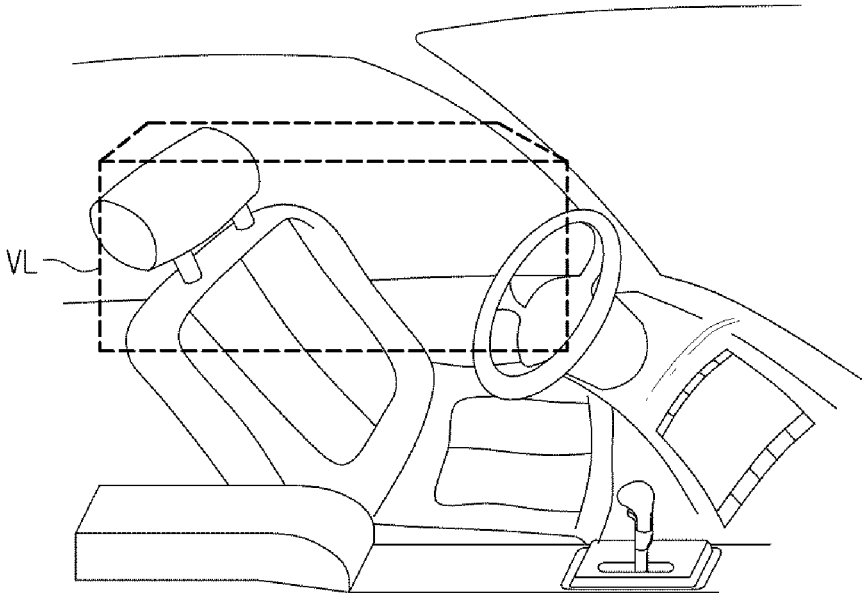
FIGS. 25A-25B and 26A-26B are views illustrating a dynamic allocation of a virtual layer in accordance with one exemplary embodiment of the present disclosure.
Figure 25B:
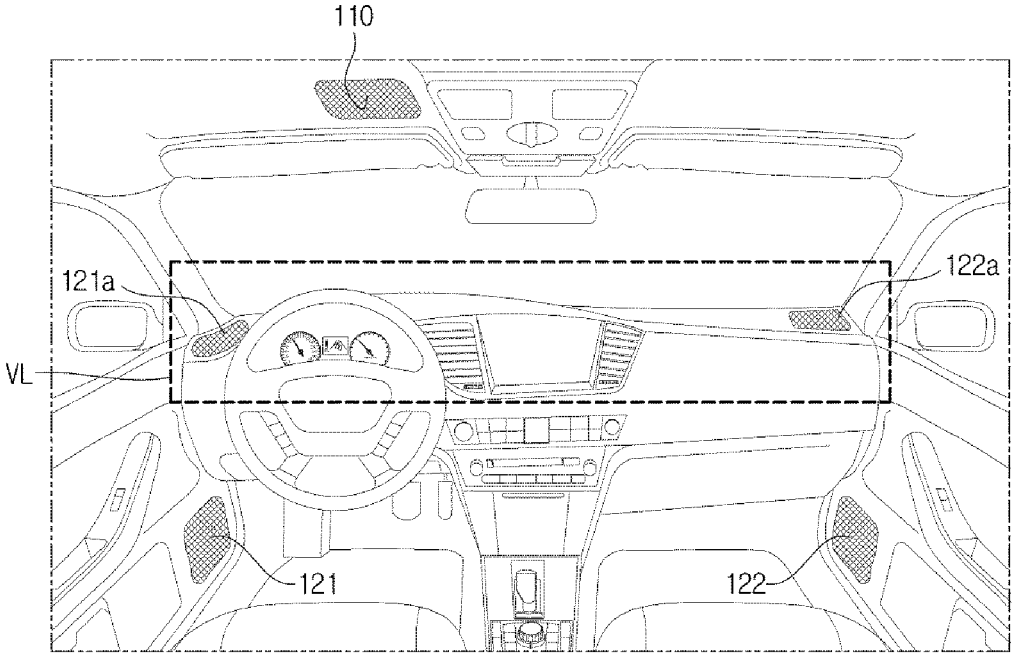
Figure 26A:
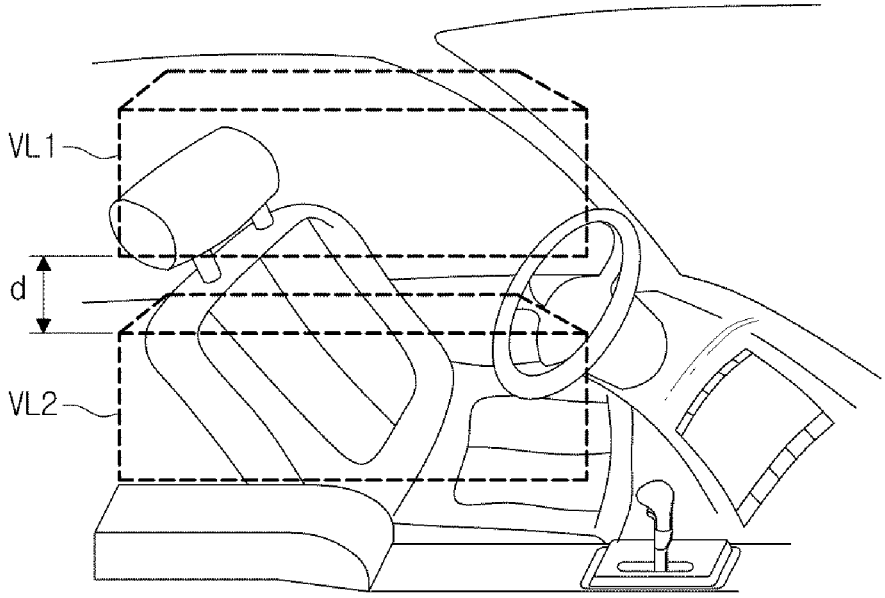
Figure 26B:
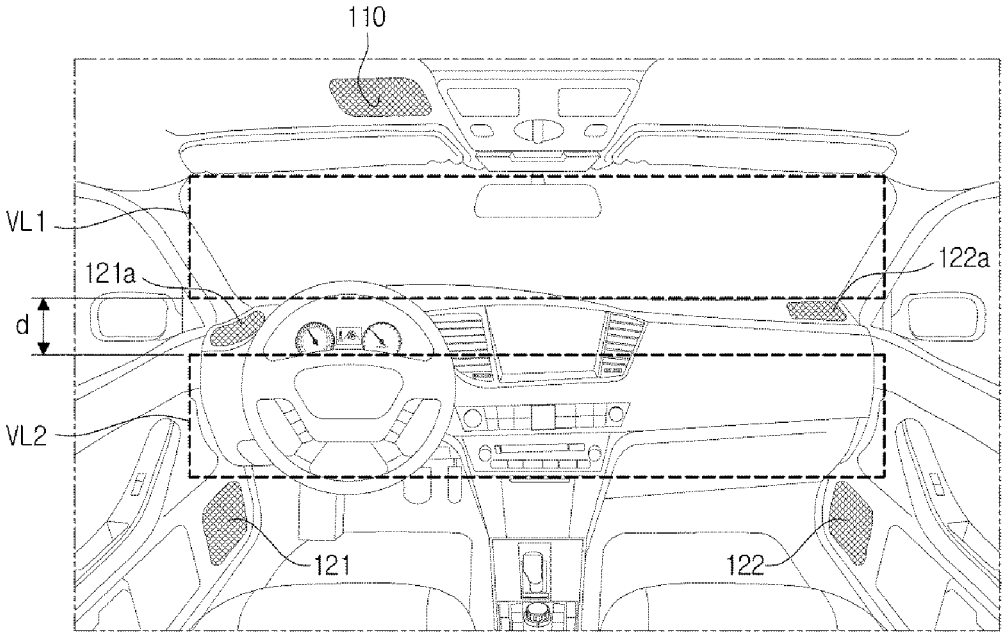

Referring to FIGS. 25A-25B and 26A-26B, the number of the virtual layer VL, which is set in the internal space of the vehicle 1, may be dynamically changed. Particularly, when a single output object sound source is present, a single virtual layer VL may be set, as illustrated in FIG. 25A-25B and when two output object sound sources are present, two virtual layers VL1 and VL2 may be set, as illustrated in FIG. 26A-26B. The first virtual layer VL1 and the second virtual layer VL2 may be set to be separated from each other by a particular distance (d), to improve the recognition of the output object sound source.

Figure 27:
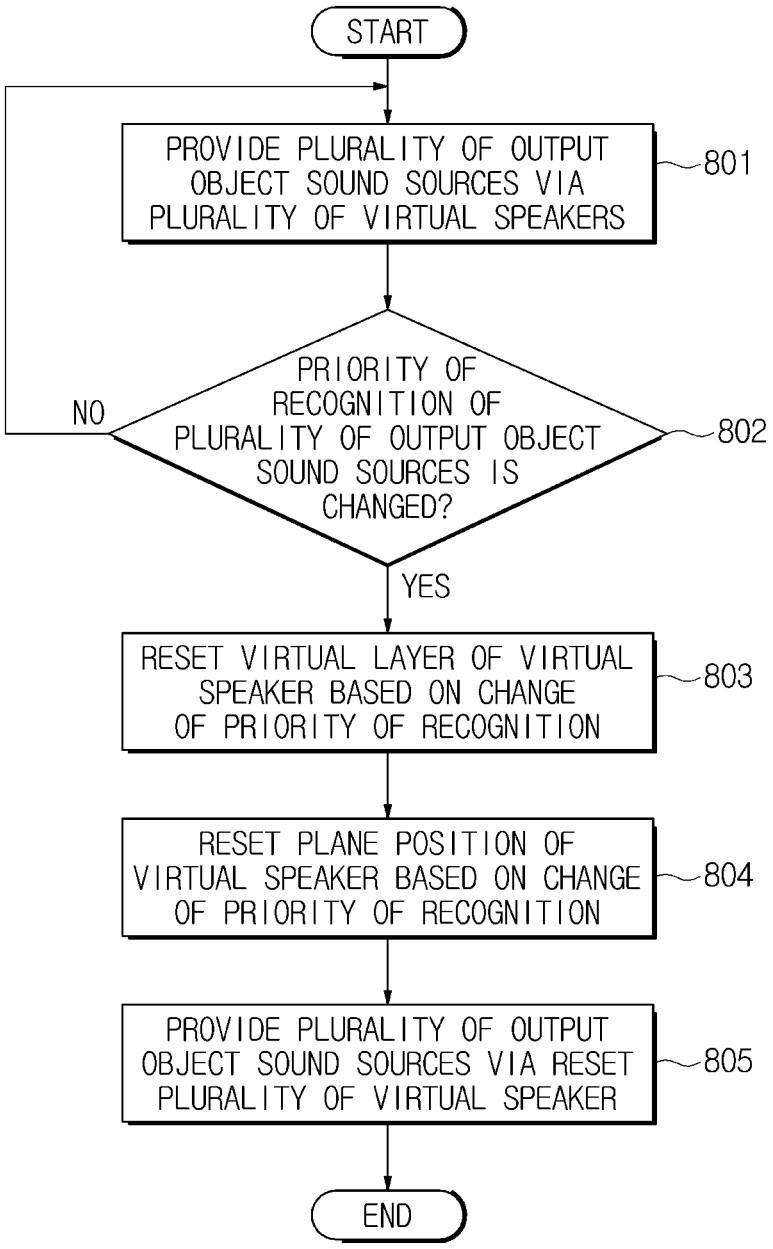
FIG. 27 is a view illustrating a method of providing a sound of a vehicle in accordance with another exemplary embodiment of the present disclosure.

FIG. 27 is a view illustrating a method of providing a sound of a vehicle in accordance with another exemplary embodiment of the present disclosure and FIGS. 28A-28C and 29A-29C are views illustrating the position variation of a virtual speaker according to a method of providing a sound of FIG. 27. Referring to FIG. 27, the vehicle 1 may provide a plurality of output object sound sources via a plurality of virtual speakers (801). The plurality of output, object sound sources may be output via the virtual speaker, which is different from each other. Each virtual speaker, which is different from each other, may be formed in each layer, which is different from each other, as mentioned above, and may have each frequency feature, which is different from each other.

Figure 28A:
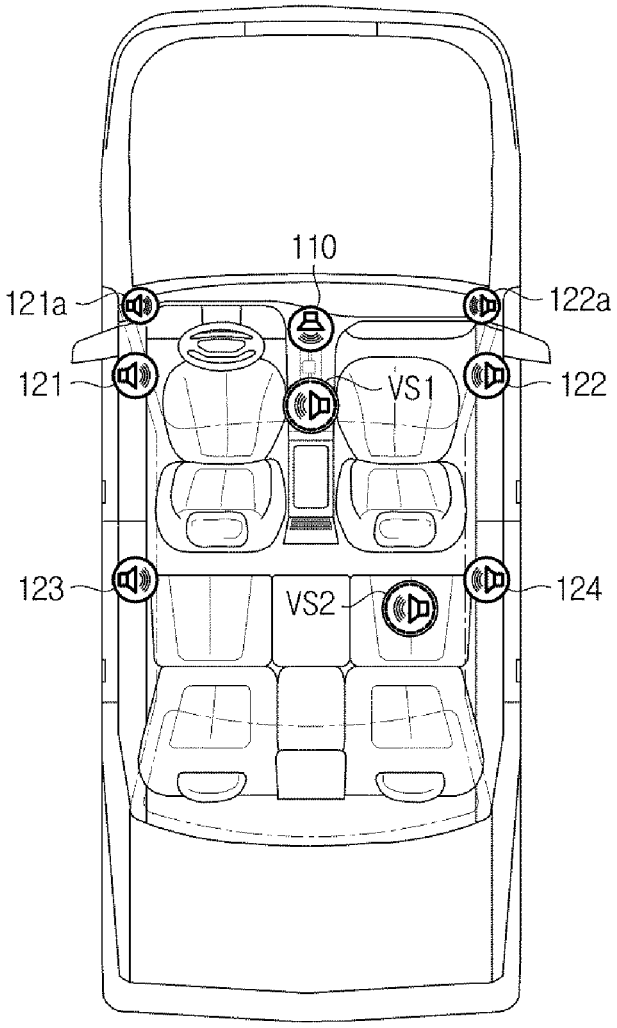
FIGS. 28A-28C and 29A-29C are views illustrating the position variation of a virtual speaker according to a method of providing a sound of FIG. 27 in accordance with one exemplary embodiment of the present disclosure.
Figure 28B:
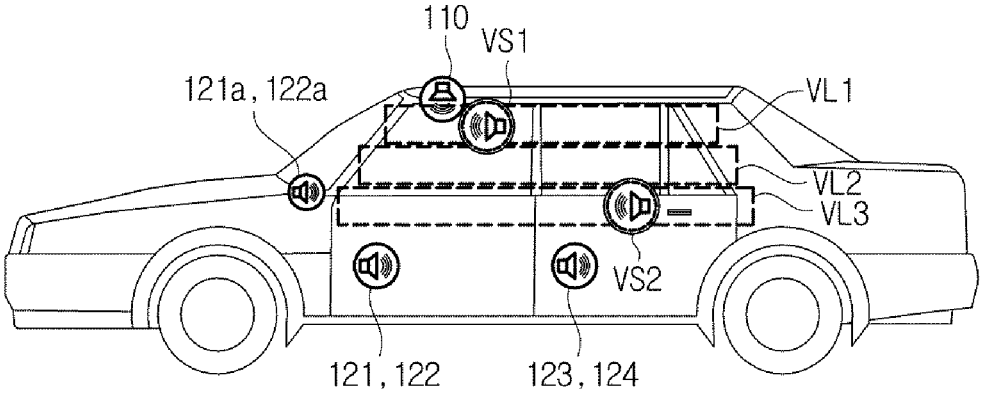
Figure 28C:
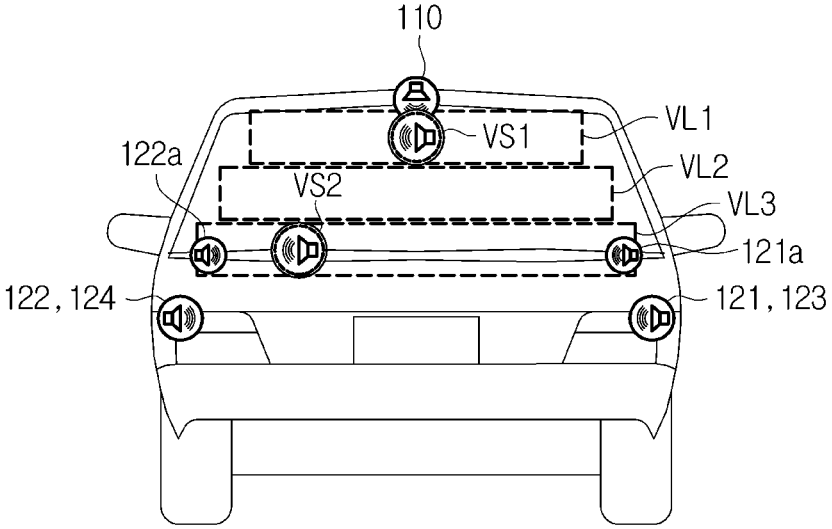

For example, as illustrated in FIG. 28A-28C, a media sound source may be provided via a first virtual speaker VS1 disposed in the center of the front of a first virtual layer VL1 and a rear collision warning sound, which is to provide a notification regarding a collision risk of the rear right, may be provided via a virtual speaker VS1 disposed in the rear right side of the third virtual layer VL3. Referring to FIG. 27, again, the vehicle 1 may be configured to determine whether the priority of recognition of the plurality of output object sound sources is changed (802). The priority of recognition of the output object sound sources may be dynamically changed based on the variation of the driving condition of the vehicle 1, and thus the sound controller 300 may be configured to monitor the change of the priority of recognition of the plurality of output object sound sources.

For example, when the vehicle 1 is moved backward (e.g., moved in reverse), the rear collision risk may vary based on a distance between the vehicle 1 and an obstacle of the rear side. In other words, when a distance between the vehicle 1 and an obstacle of the rear side is greater than a predetermined distance, the rear collision risk may be reduced, and thus the priority of recognition of the rear collision risk warning sound source may be relatively low. When a distance between the vehicle 1 and an obstacle of the rear side is less than a predetermined distance (e.g. minimal, close to the vehicle), the rear collision risk may be increased, and thus the priority of recognition of the rear collision risk warning sound source may be relatively high.

As another example, the priority of recognition of the guidance sound source to guide a driving path of the vehicle 1 may vary based on the variation of the (hiving condition of the vehicle 1. Particularly, when a distance between a point, in which a driving path of the vehicle 1 is requires to be changed, and the vehicle is distant, the priority of recognition of the guide sound source may be relatively low, and when a distance between a point, in which a driving path of the vehicle. I is required to be changed, and the vehicle is close, the priority of recognition of the guide sound source may be relatively high.

When the priority of recognition of the plurality of output object sound source are changed (YES of 802), the vehicle 1 may be configured to reset the virtual layer of the virtual speaker based on the change of the priority of recognition (803). As mentioned above, the sound controller 300 may be configured to change the virtual layer of the virtual speaker to adjust a virtual speaker that corresponds to an output object sound source having an increased priority of recognition to correspond to the height of the driver's head, and a virtual speaker that corresponds to an output object sound source having a lowered priority of recognition may be separated from the driver's head. In other words, the sound controller 300 may be configured to reset the height, at which the virtual speaker is formed, according to the change of the priority of recognition of the output object sound source.

Figure 29A:
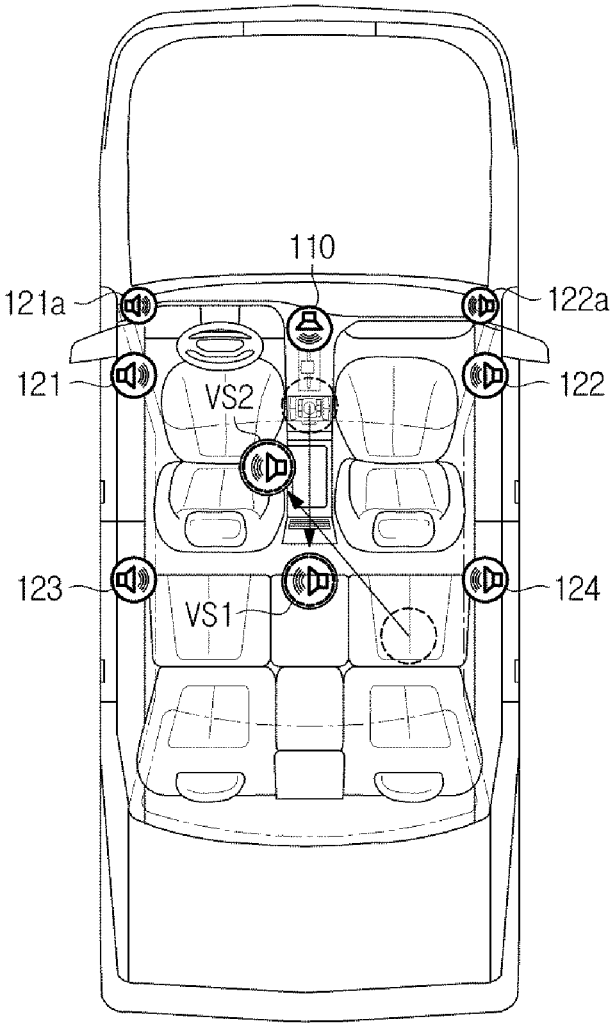
Figure 29B:
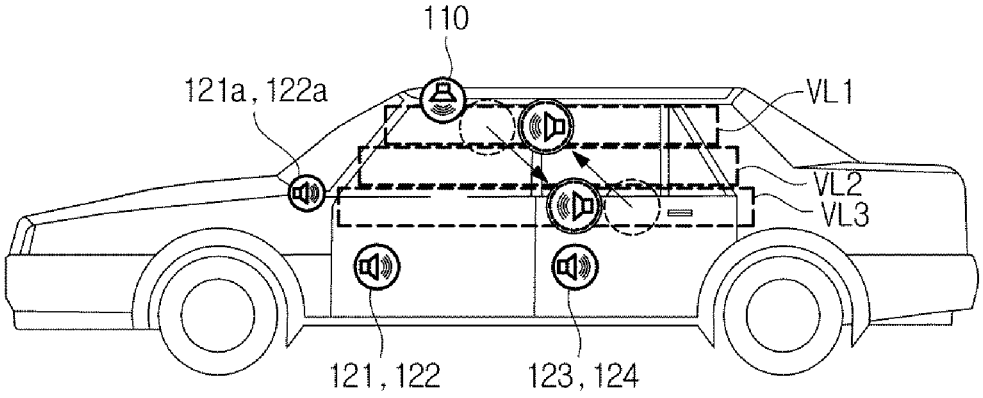
Figure 29C:
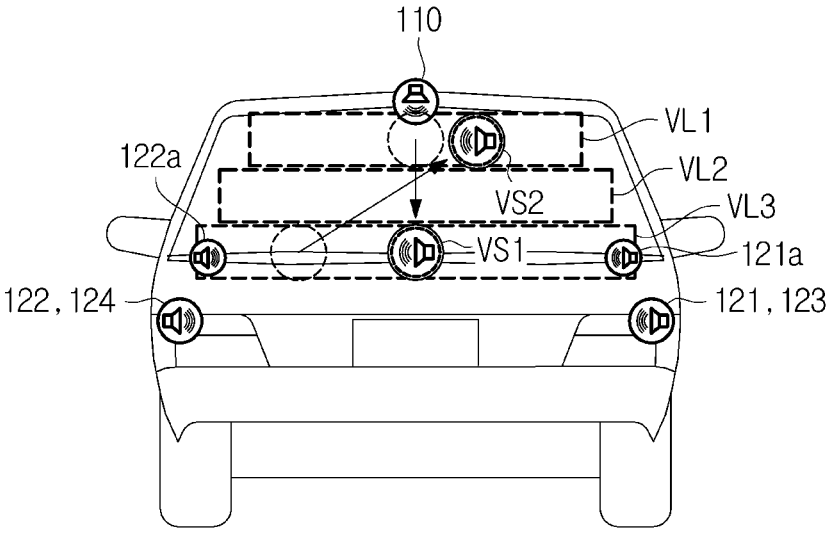

Referring to FIG. 29A-29C, for example, when the priority of recognition of the rear collision warning sound source is increased, the sound controller 300 may be configured to set a virtual layer of the second virtual speaker VS2 providing the rear collision warning sound source, as the first virtual layer VL1, and may he configured to set a virtual layer of the first virtual speaker VS1 providing a media sound source having a relatively low priority of recognition, as the third virtual layer VL3.

Referring to FIG. 27 again, the vehicle may be configured to reset a plane position of the virtual speaker VS based on the priority of recognition (804). The sound controller 300 may be configured to position a virtual speaker that provides an output object sound source having a higher priority of recognition in a plane surface closer to the driver, and may be configured to position a virtual speaker that provides an output object sound source having a lower priority of recognition in a plane surface further from the driver. A particular plane position of the virtual speaker may be determined based on the feature of the output object sound source, as mentioned above.

Referring to FIG. 29A-29C, for example, when the priority of recognition of the rear collision risk warning sound source is increased, the sound controller 300 may be configured to reset a plane position of the second virtual speaker VS2 that provides the rear collision risk warning sound source, as a position proximate to the driver, and may be configured to reset a plane position of the first virtual speaker VS1 that provides the media sound source having a relatively lowered priority of recognition, as a position separated from the driver The plane position of the second virtual speaker VS2 may he set in a direction that corresponds to a direction in which a collision risk is present to allow a user to more easily recognize the collision risk position.

The vehicle 1 may be configured to provide a plurality of output object sound sources via the reset plurality of virtual speakers VS1 (805). As mentioned above, by dynamically changing the position of the virtual speaker according to the priority of recognition of the output object sound source, the sound recognition of the user may be improved. Particularly, by dynamically changing the position of the virtual speaker according to the priority of recognition of the guidance sound source and the warning sound source, the guidance sound source and the warning sound source may he effectively recognized.

As is apparent from the above description, according to the proposed vehicle capable of providing a plurality of sound sources in different layer, and the control method of the vehicle, the sound recognition of the user may be improved.

Although exemplary embodiments of the present disclosure have been shown and described, it would he appreciated by those skilled in the art that changes may be made in these embodiments without departing from the principles and spirit of the disclosure, the scope of which is defined in the claims and their equivalents.

DESCRIPTION OF NUMERAL REFERENCE

1: vehicle
100: speaker
210: media device
220: navigator
230: communication device
240: proximity sensor
250: main processor
260: storage device
300: sound controller
310: sound source handler
320: parameter generator
330: signal processor
340: sound source converter
500: sound source controller
510: event handler
530: media sound source controller
240: event sound source controller

What is claimed is:

1. A vehicle, comprising:

a memory comprising processor executable instructions;

a plurality of speakers disposed at different heights within the vehicle;

at least one hardware processor interfaced to the memory and configured to execute the processor executable instructions in the memory to implement a sound controller configured to set a plurality of virtual speakers, each providing a respective sound source, at different positions within the vehicle by controlling the plurality of speakers and to provide a plurality of sound sources by using the plurality of virtual speakers.

2. The vehicle of claim 1 wherein the sound controller is provided in the at least one hardware processor to determine a speaker among the plurality of speakers, to which an audio signal that corresponds to a sound source is applied, based on a position of the virtual speaker.

3. The vehicle of claim 2 wherein the sound controller is provided in the at least one hardware processor to form the plurality of virtual speakers in different layers according to the priority of recognition.

4. The vehicle of claim 3 wherein the sound controller is provided in the at least one hardware processor to set a virtual speaker that corresponds to a sound source having a high priority of recognition among a plurality of sound sources, in a layer that corresponds to a height of a driver's head, and set a virtual speaker that corresponds to a sound source having a low priority of recognition among the plurality of sound sources, in a layer lower than the height of the driver's head.

5. The vehicle of claim 3 wherein the sound controller is provided in the at least one hardware processor to set plane coordinates of the plurality of virtual speakers to form a virtual speaker that corresponds to a sound source having a high priority of recognition among the plurality of sound sources to be closer to a driver than a virtual speaker that corresponds to a sound source having a low priority of recognition among a plurality of sound sources.

6. The vehicle of claim 2 wherein the sound controller is provided in the at least one hardware processor to provide a sound source having a high priority of recognition as a high pitch sound, and a sound source having a low priority of recognition as a low pitch sound.

7. The vehicle of claim 1 wherein the sound controller is provided in the at least one hardware processor to generate an audio signal, to be applied to each of the plurality of speakers, based on a distance between the plurality of speakers and the virtual speaker.

8. The vehicle of claim 7 wherein the sound controller is provided in the at least one hardware processor to adjust a gain of an audio signal, to be applied to each of the plurality of speakers, based on a distance between the plurality of speakers and the virtual speaker.

9. The vehicle of claim 7 wherein the sound controller is provided in the at least one hardware processor to adjust an output timing of the audio signal based on a distance between each speaker and the virtual speaker.

10. The vehicle of claim 7 wherein the sound controller is provided in the at least one hardware processor to adjust a frequency of the audio signal, to be applied to each speaker, based on a distance between each speaker and the virtual speaker.

11. The vehicle of claim 7 wherein the sound controller is provided in the at least one hardware processor to generate the audio signal, to be applied to the plurality of speakers, based on the following equation $$S^n(t, f) = k_n \cdot A(t) \cdot e^{j2\pi\left(\left(1 + \frac{\Theta_n}{c}\right) \cdot f\right) \cdot t}$$

wherein, S represents the audio signal, n represents each channel of the plurality of speakers, t represents an output time of the audio signal, A represents the size of a sound source to be provided via the virtual speaker, f represents a frequency of a sound source to be provided via the virtual speaker, c represents the speed of sound when air is the medium, k represents a variation to adjust a gain of the audio signal based on a distance between the virtual speaker and each speaker, and θ represents a variation to adjust a frequency of the audio signal based on a distance between the virtual speaker and each speaker.

12. A control method of a vehicle including a plurality of speakers disposed at different heights, comprising:

setting, by a controller, a plurality of virtual speakers, to provide each sound source, in different positions based on the priority of recognition of the plurality of sound sources by using the plurality of speakers; and providing, by the controller, the plurality of sound sources at the same time using the plurality of virtual speakers.

13. The control method of claim 12 wherein:

the setting includes at least one operation selected from the group consisting of: determining a gain, to be applied to each of the plurality of speakers, based on a distance between the plurality of speakers and the virtual speaker, determining an output timing of the audio signal based on a distance between each speaker and the virtual speaker, and adjusting a frequency of an audio signal, to be applied to each speaker, based on a distance between each speaker and the virtual speaker.

* * * * *